US012385675B2

(12) United States Patent
Iyoshi et al.

(10) Patent No.: US 12,385,675 B2
(45) Date of Patent: Aug. 12, 2025

(54) REFRIGERATION CYCLE APPARATUS

(71) Applicant: DAIKIN INDUSTRIES, LTD., Osaka (JP)

(72) Inventors: Yuuta Iyoshi, Osaka (JP); Yoshiki Yamanoi, Osaka (JP); Kumiko Saeki, Osaka (JP)

(73) Assignee: DAIKIN INDUSTRIES, LTD., Osaka (JP)

( * ) Notice: Subject to any disclaimer, the term of this patent is extended or adjusted under 35 U.S.C. 154(b) by 213 days.

(21) Appl. No.: 17/982,148

(22) Filed: Nov. 7, 2022

(65) Prior Publication Data

US 2023/0057478 A1 Feb. 23, 2023

Related U.S. Application Data

(63) Continuation of application No. PCT/JP2021/017705, filed on May 10, 2021.

(30) Foreign Application Priority Data

May 8, 2020 (JP) ..... 2020-082787
May 8, 2020 (JP) ..... 2020-082788
(Continued)

(51) Int. Cl.
*F25B 13/00* (2006.01)
*F25B 9/00* (2006.01)
*F25B 9/10* (2006.01)

(52) U.S. Cl.
CPC ..... *F25B 13/00* (2013.01); *F25B 9/008* (2013.01); *F25B 9/10* (2013.01);
(Continued)

(58) Field of Classification Search
CPC .. F25B 13/00; F25B 9/008; F25B 9/10; F25B 2313/007; F25B 2313/0233; F25B 2313/02742; F25B 7/00
See application file for complete search history.

(56) References Cited

U.S. PATENT DOCUMENTS 5,383,339 A 1/1995 McCloskey et al.
10,094,577 B2 10/2018 Dennis
(Continued)

FOREIGN PATENT DOCUMENTS

CN 102884384 A 1/2013
CN 203940649 U 11/2014
(Continued)

OTHER PUBLICATIONS

English language translation of WO2018235832 (Year: 2018).*
(Continued)

*Primary Examiner* — Cassey D Bauer
(74) *Attorney, Agent, or Firm* — Birch, Stewart, Kolasch & Birch, LLP

(57) ABSTRACT

A refrigeration cycle apparatus includes a primary-side refrigerant circuit in which a first refrigerant circulates and a secondary-side refrigerant circuit in which a second refrigerant circulates. The primary-side refrigerant circuit includes a primary-side compressor, a primary-side flow path of a cascade heat exchanger, a primary-side heat exchanger, and a primary-side switching mechanism. The secondary-side refrigerant circuit includes a secondary-side compressor, a secondary-side flow path of the cascade heat exchanger, a secondary-side switching mechanism, a suction flow path, a plurality of utilization-side heat exchangers, a first connection flow path, connecting the plurality of utilization-side heat exchangers and the secondary-side switching mechanism, including a secondary-side first connection pipe, a first heat source pipe, first branch pipes, junction
(Continued)

pipes, first connection pipes, and first utilization pipes, a second connection flow path, connecting the plurality of utilization-side heat exchangers and the suction flow path, including a secondary side second connection pipe, a second heat source pipe, second branch pipes, the junction pipes, the first connection pipes, and the first utilization pipes, a third connection flow path, connecting the plurality of utilization-side heat exchangers and the secondary-side flow path of the cascade heat exchanger, including a secondary-side third connection pipe, a fourth heat source pipe, a fifth heat source pipe, third branch pipes, second connection pipes, and second utilization pipes.

19 Claims, 13 Drawing Sheets

(30) Foreign Application Priority Data

| | | |
|---|---|---|
| May 8, 2020 | (JP) | 2020-082789 |
| Dec. 1, 2020 | (JP) | 2020-199793 |
| Dec. 1, 2020 | (JP) | 2020-199794 |
| Dec. 1, 2020 | (JP) | 2020-199795 |
| Dec. 1, 2020 | (JP) | 2020-199796 |

(52) U.S. Cl.
CPC . *F25B 2313/007* (2013.01); *F25B 2313/0233* (2013.01); *F25B 2313/02742* (2013.01)

(56) References Cited

U.S. PATENT DOCUMENTS

| | | | |
|---|---|---|---|
| 10,184,676 | B2 | 1/2019 | Kawano et al. |
| 2004/0134225 | A1 | 7/2004 | Sakamoto et al. |
| 2009/0031739 | A1 | 2/2009 | Kasahara et al. |
| 2009/0255284 | A1 | 10/2009 | Yoshimi |
| 2010/0000245 | A1 | 1/2010 | Kasahara et al. |
| 2010/0050675 | A1 | 3/2010 | Kameyama et al. |
| 2011/0016897 | A1 | 1/2011 | Akagi et al. |
| 2011/0289952 | A1 | 12/2011 | Kim et al. |
| 2013/0255309 | A1 | 10/2013 | Wu et al. |
| 2014/0013790 | A1 | 1/2014 | Asari et al. |
| 2017/0010027 | A1 | 1/2017 | Liu et al. |
| 2017/0182869 | A1 | 6/2017 | Kujak et al. |
| 2019/0137147 | A1 | 5/2019 | Petersen et al. |
| 2019/0264957 | A1 | 8/2019 | Petersen et al. |
| 2023/0057478 | A1 | 2/2023 | Iyoshi et al. |
| 2023/0304709 | A1 | 9/2023 | Iyoshi et al. |
| 2023/0304711 | A1 | 9/2023 | Iyoshi et al. |
| 2023/0324085 | A1 | 10/2023 | Iyoshi et al. |
| 2023/0324086 | A1 | 10/2023 | Lyoshi et al. |

FOREIGN PATENT DOCUMENTS

| | | | |
|---|---|---|---|
| CN | 210980415 | U | 7/2020 |
| EP | 1 967 801 | A2 | 9/2008 |
| EP | 2 314 953 | A1 | 4/2011 |
| EP | 2 623 898 | A1 | 8/2013 |
| EP | 2 910 870 | A1 | 8/2015 |
| EP | 2 672 204 | B1 | 7/2017 |
| EP | 3 312 524 | A1 | 4/2018 |
| EP | 3 348 934 | A1 | 7/2018 |
| EP | 3 457 049 | A1 | 3/2019 |
| EP | 3 643 988 | A1 | 4/2020 |
| EP | 3 862 656 | A1 | 8/2021 |
| JP | 59-38568 | A | 3/1984 |
| JP | 61-41563 | U | 3/1986 |
| JP | 63-58048 | A | 3/1988 |
| JP | 63-65245 | A | 3/1988 |
| JP | 8-210717 | A | 8/1996 |
| JP | 2000-121183 | A | 4/2000 |
| JP | 2001-336856 | A | 12/2001 |
| JP | 2003-28524 | A | 1/2003 |
| JP | 2004-190917 | A | 7/2004 |
| JP | 2005-77042 | A | 3/2005 |
| JP | 2005-299935 | A | 10/2005 |
| JP | 2007-218460 | A | 8/2007 |
| JP | 2007-240108 | A | 9/2007 |
| JP | 2007-248001 | A | 9/2007 |
| JP | 2008-39332 | A | 2/2008 |
| JP | 2009-139014 | A | 6/2009 |
| JP | 2009-210142 | A | 9/2009 |
| JP | 4377634 | B2 | 12/2009 |
| JP | 2011-127878 | A | 6/2011 |
| JP | 2012-112615 | A | 6/2012 |
| JP | 2012-184873 | A | 8/2012 |
| JP | 5113447 | B2 | 1/2013 |
| JP | 2013-210150 | A | 10/2013 |
| JP | 2014-109405 | A | 6/2014 |
| JP | 5627417 | B2 | 11/2014 |
| JP | 2016-11783 | A | 1/2016 |
| JP | 2018-112367 | A | 7/2018 |
| JP | 2019-20090 | A | 2/2019 |
| WO | WO 2014/045400 | A1 | 3/2014 |
| WO | WO 2016/203624 | A1 | 12/2016 |
| WO | WO 2018/235832 | A1 | 12/2018 |
| WO | WO 2020/071300 | A1 | 4/2020 |
| WO | WO 2021/225177 | A1 | 11/2021 |

OTHER PUBLICATIONS

International Preliminary Report on Patentability and English translation of the Written Opinion of the International Searching Authority for International Application No. PCT/JP2021/043881, dated Jun. 15, 2023.

International Preliminary Report on Patentability and English translation of the Written Opinion of the International Searching Authority for International Application No. PCT/JP2021/043882, dated Jun. 15, 2023.

International Preliminary Report on Patentability and English translation of the Written Opinion of the International Searching Authority for International Application No. PCT/JP2021/043883, dated Jun. 15, 2023.

International Preliminary Report on Patentability and English translation of the Written Opinion of the International Searching Authority for International Application No. PCT/JP2021/043884, dated Jun. 15, 2023.

Extended European Search Report for European Application No. 21900594.9, dated Apr. 4, 2024.

Extended European Search Report for European Application No. 21900595.6, dated Apr. 11, 2024.

Extended European Search Report for European Application No. 21800672.4, dated Sep. 5, 2023.

Extended European Search Report for European Application No. 21799922.6, dated Jan. 2, 2024.

Extended European Search Report for European Application No. 21900597.2, dated Jul. 9, 2024.

International Search Report for PCT/JP2021/017688 mailed on Jun. 8, 2021.

International Search Report for PCT/JP2021/017705 mailed on Jun. 22, 2021.

International Search Report for PCT/JP2021/017755 mailed on Jul. 6, 2021.

International Search Report for PCT/JP2021/043881 mailed on Jan. 11, 2022.

International Search Report for PCT/JP2021/043882 mailed on Jan. 11, 2022.

International Search Report for PCT/JP2021/043883 mailed on Jan. 11, 2022.

International Search Report for PCT/JP2021/043884 mailed on Jan. 11, 2022.

International Search Report for PCTJP2021/017689 mailed on Jun. 8, 2021.

Written Opinion of the International Searching Authority for PCT/JP2021/017705 mailed on Jun. 22, 2021.

(56) References Cited

OTHER PUBLICATIONS

Extended European Search Report for European Application No. 21800967.8, dated Oct. 5, 2023.
International Preliminary Report on Patentability and English translation of the Written Opinion of the International Searching Authority, for International Application No. PCT/JP2021/017688, dated Nov. 17, 2022.
International Preliminary Report on Patentability and English translation of the Written Opinion of the international Searching Authority, for International Application No. PCT/JP2021/017689, dated Nov. 17, 2022.
International Preliminary Report on Patentability and English translation of the Written Opinion of the International Searching Authority, for International Application No. PCT/JP2021/017705, dated Nov. 17, 2022.
International Preliminary Report on Patentability and English translation of the Written Opinion of the International Searching Authority, for International Application No. PCT/JP2021/017755, dated Nov. 17, 2022.
Extended European Search Report for European Application No. 21900596.4, dated Apr. 26, 2024.

* cited by examiner

REFRIGERATION CYCLE APPARATUS

CROSS REFERENCE TO RELATED APPLICATIONS

This application is a Continuation of PCT International Application No. PCT/JP2021/017705, filed on May 10, 2021, which claims priority under 35 U.S.C. 119(a) to Patent Application No. 2020-082789, filed in Japan on May 8, 2020, Patent Application No. 2020-082788, filed in Japan on May 8, 2020, Patent Application No. 2020-082787, filed in Japan on May 8, 2020, Patent Application No. 2020-199795, filed in Japan on Dec. 1, 2020, Patent Application No. 2020-199796, filed in Japan on Dec. 1, 2020, Patent Application No. 2020-199793, filed in Japan on Dec. 1, 2020, and Patent Application No. 2020-199794, filed in Japan on Dec. 1, 2020, all of which are hereby expressly incorporated by reference into the present application.

TECHNICAL FIELD

The present disclosure relates to a refrigeration cycle apparatus.

BACKGROUND ART

Conventionally, as described in Patent Literature 1 (WO 2018/235832 A), there has been proposed a refrigeration cycle apparatus that includes a primary-side refrigerant circuit and a secondary-side refrigerant circuit, and is capable of performing cooling operation and heating operation in a plurality of utilization-side heat exchangers in the secondary-side refrigerant circuit.

Further, in the refrigeration cycle apparatus described in Patent Literature 1, there has been proposed a circuit configuration that enables simultaneous cooling and heating operation in which a part of the plurality of utilization-side heat exchangers performs cooling operation while another part of the plurality of utilization-side heat exchangers performs heating operation.

SUMMARY

A refrigeration cycle apparatus according to a first aspect includes a first circuit and a second circuit. The first circuit includes a first compressor, a first portion of a cascade heat exchanger, a first heat exchanger, and a first switching mechanism located between the first compressor and the first heat exchanger and switching a flow path. A first refrigerant circulates through the first circuit. The second circuit includes a second compressor, a discharge flow path extending from a discharge side of the second compressor, a suction flow path extending from a suction side of the second compressor, a second portion of the cascade heat exchanger, a second switching mechanism, a plurality of second heat exchangers, a first connection flow path, a second connection flow path, and a third connection flow path. A second refrigerant circulates through the second circuit. The first connection flow path connects the second switching mechanism and the plurality of second heat exchangers. The second connection flow path connects the plurality of second heat exchangers and the suction flow path or a portion of the second switching mechanism on a suction flow path side. The third connection flow path connects the plurality of second heat exchangers and the second portion of the cascade heat exchanger. The second switching mechanism is connected with the discharge flow path, the suction flow path, a flow path extending from the second portion of the cascade heat exchanger, and the first connection flow path, and switches a flow path.

BRIEF DESCRIPTION OF THE DRAWINGS

DESCRIPTION OF EMBODIMENTS (1) Configuration of Refrigeration Cycle Apparatus FIG. 1 is a schematic configuration diagram of a refrigeration cycle apparatus 1. FIG. 2 is a schematic functional block configuration diagram of the refrigeration cycle apparatus 1.

Figure 1:
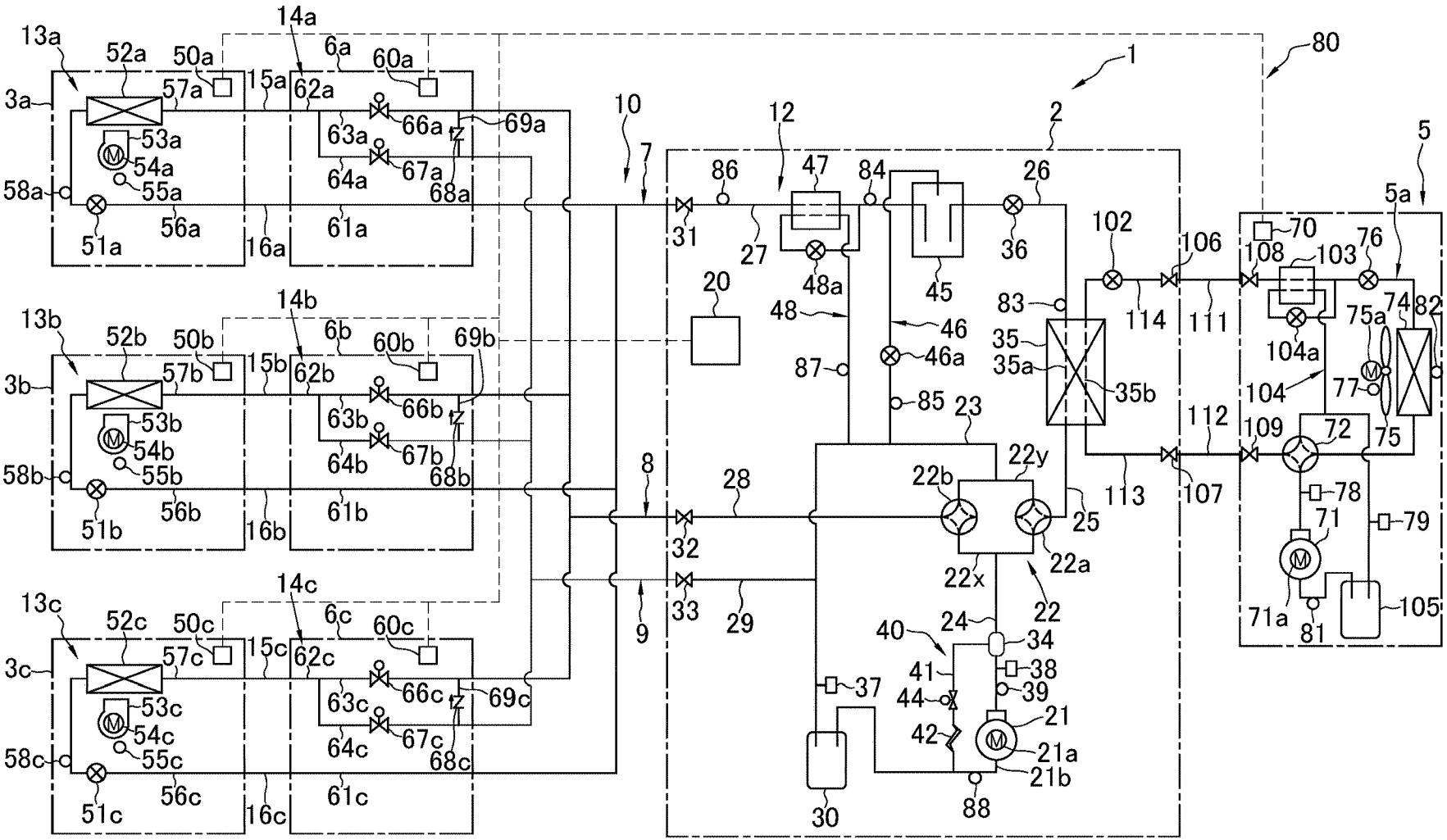
FIG. 1 is a schematic configuration diagram of a refrigeration cycle apparatus.
Figure 2:
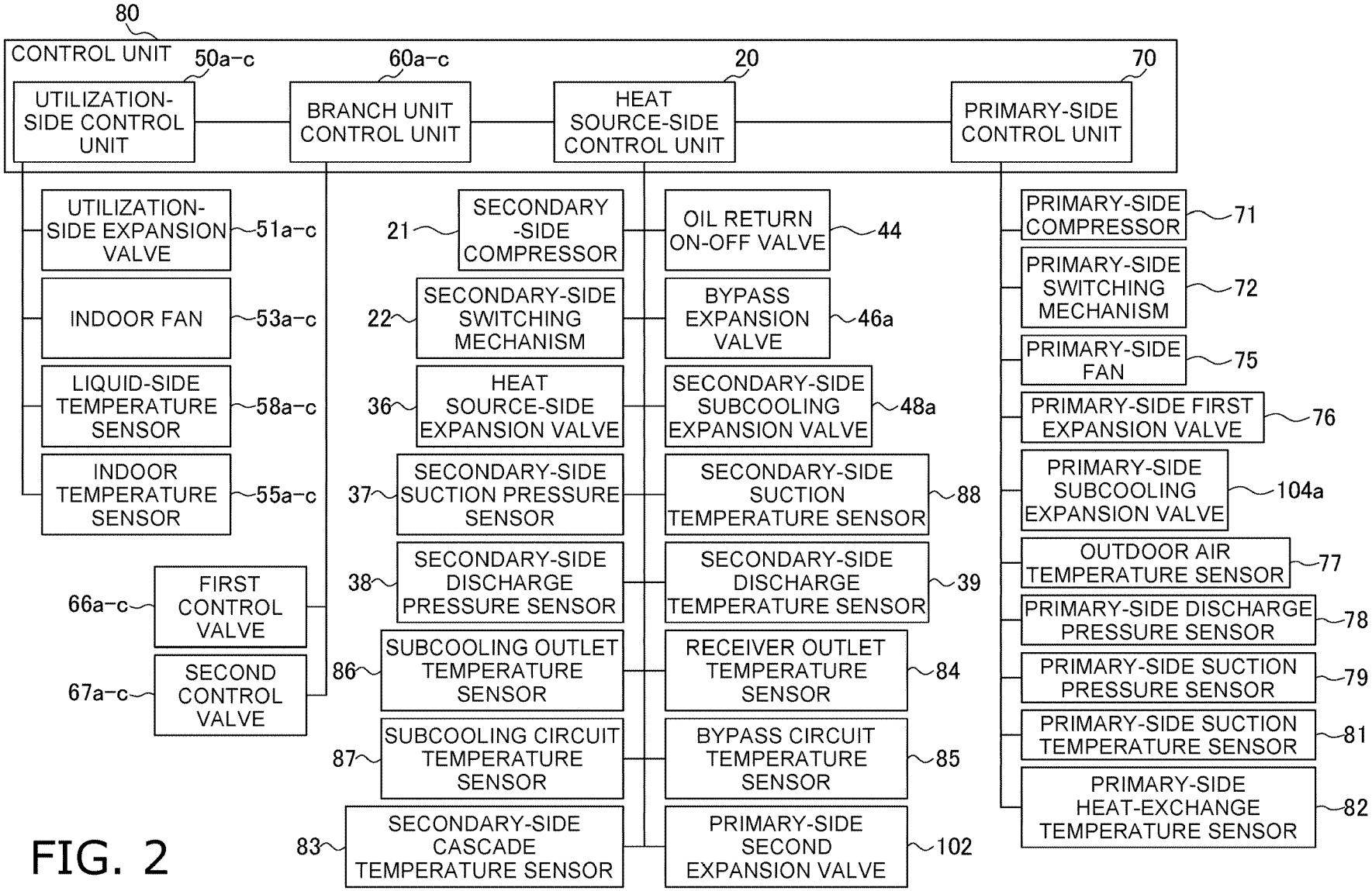
FIG. 2 is a schematic functional block configuration diagram of the refrigeration cycle apparatus.

The refrigeration cycle apparatus 1 is an apparatus used for cooling and heating of a room in a building or the like by performing vapor compression refrigeration cycle operation.

The refrigeration cycle apparatus 1 includes a binary refrigerant circuit including a vapor compression primary-side refrigerant circuit 5*a* (corresponding to a first circuit) and a vapor compression secondary-side refrigerant circuit 10 (corresponding to a second circuit), and performs a binary refrigeration cycle. In the primary-side refrigerant circuit 5*a*, for example, R32 or R410A (corresponding to a first refrigerant) is sealed as a refrigerant. In the secondary-side refrigerant circuit 10, for example, carbon dioxide (corresponding to a second refrigerant) is sealed as a refrigerant. The primary-side refrigerant circuit 5*a* and the secondary-side refrigerant circuit 10 are thermally connected via a cascade heat exchanger 35 described later.

The refrigeration cycle apparatus 1 is configured by connecting a primary-side unit 5, a heat source unit 2, a plurality of branch units 6*a*, 6*b*, and 6*c*, and a plurality of utilization units 3*a*, 3*b*, and 3*c* to each other via pipes. The primary-side unit 5 and the heat source unit 2 are connected by a primary-side first connection pipe 111 and a primary-side second connection pipe 112. The heat source unit 2 and the plurality of branch units 6*a*, 6*b*, and 6*c* are connected by three connection pipes of a secondary-side second connection pipe 9, a secondary-side first connection pipe 8, and a secondary-side third connection pipe 7. The plurality of branch units 6*a*, 6*b*, and 6*c* and the plurality of utilization units 3*a*, 3*b*, and 3*c* are connected by first connection pipes 15*a*, 15*b*, and 15*c* and second connection pipes 16*a*, 16*b*, and 16*c*. In the present embodiment, there is one primary-side unit 5. In the present embodiment, there is one heat source unit 2. In the present embodiment, the plurality of utilization units 3*a*, 3*b*, and 3*c* is three utilization units of a first utilization unit 3*a*, a second utilization unit 3*b*, and a third utilization unit 3*c*. In the present embodiment, the plurality of branch units 6*a*, 6*b*, and 6*c* is three branch units of a first branch unit 6*a*, a second branch unit 6*b*, and a third branch unit 6*c*.

In the refrigeration cycle apparatus 1, the utilization units 3*a*, 3*b*, and 3*c* can individually perform cooling operation or heating operation, and heat can be recovered between the utilization units by sending a refrigerant from the utilization unit performing the heating operation to the utilization unit performing the cooling operation. Specifically, in the present embodiment, the heat is recovered by performing cooling main operation or heating main operation in which the cooling operation and the heating operation are simultaneously performed. In addition, the refrigeration cycle apparatus 1 is configured to balance thermal loads of the heat source unit 2 in accordance with entire thermal loads of the plurality of utilization units 3*a*, 3*b*, and 3*c* also in consideration of the heat recovery (the cooling main operation or the heating main operation).

(2) Primary-Side Refrigerant Circuit

The primary-side refrigerant circuit 5*a* includes a primary-side compressor 71 (corresponding to a first compressor), a primary-side switching mechanism 72 (corresponding to a first switching mechanism), a primary-side heat exchanger 74 (corresponding to a first heat exchanger), a primary-side first expansion valve 76, a primary-side subcooling heat exchanger 103, a primary-side subcooling circuit 104, a primary-side subcooling expansion valve 104*a*, a first liquid shutoff valve 108, the primary-side first connection pipe 111, a second liquid shutoff valve 106, the second refrigerant pipe 114, a primary-side second expansion valve 102, the cascade heat exchanger 35 shared with the secondary-side refrigerant circuit 10, a first refrigerant pipe 113, a second gas shutoff valve 107, the primary-side second connection pipe 112, a first gas shutoff valve 109, and a primary-side accumulator 105. This primary-side refrigerant circuit 5*a* specifically includes a primary-side flow path 35*b* (corresponding to a first portion) of the cascade heat exchanger 35.

The primary-side compressor 71 is a device for compressing a primary-side refrigerant, and includes, for example, a scroll type or other positive-displacement compressor whose operating capacity can be varied by controlling an inverter for a compressor motor 71*a*.

The primary-side accumulator 105 is provided in the middle of a suction flow path connecting the primary-side switching mechanism 72 and a suction side of the primary-side compressor 71.

When the cascade heat exchanger 35 is caused to function as an evaporator for the primary-side refrigerant, the primary-side switching mechanism 72 is brought into a fifth connection state where the suction side of primary-side compressor 71 and a gas side of the primary-side flow path 35*b* of the cascade heat exchanger 35 are connected (see solid lines in the primary-side switching mechanism 72 in FIG. 1). Further, when the cascade heat exchanger 35 is caused to function as a radiator for the primary-side refrigerant, the primary-side switching mechanism 72 is brought into a sixth connection state where a discharge side of the primary-side compressor 71 and the gas side of the primary-side flow path 35*b* of the cascade heat exchanger 35 are connected (see broken lines in the primary-side switching mechanism 72 in FIG. 1). As described above, the primary-side switching mechanism 72 is a device capable of switching a refrigerant flow path in the primary-side refrigerant circuit 5*a*, and includes, for example, a four-way switching valve. By changing a switching state of the primary-side switching mechanism 72, the cascade heat exchanger 35 can function as an evaporator or a radiator for the primary-side refrigerant.

The cascade heat exchanger 35 is a device for exchanging heat between a refrigerant such as R32 which is a primary-side refrigerant and a refrigerant such as carbon dioxide which is a secondary-side refrigerant without being mixed with each other. The cascade heat exchanger 35 is, for example, a plate-type heat exchanger. The cascade heat exchanger 35 includes a secondary-side flow path 35*a* belonging to the secondary-side refrigerant circuit 10 and the primary-side flow path 35*b* belonging to the primary-side refrigerant circuit 5*a*. The secondary-side flow path 35*a* has a gas side connected to a secondary-side switching mechanism 22 via a third heat source pipe 25 and a liquid side connected to a heat source-side expansion valve 36 via a fourth heat source pipe 26. The primary-side flow path 35*b* has a gas side connected to the primary-side compressor 71 via the first refrigerant pipe 113, the second gas shutoff valve 107, the primary-side second connection pipe 112, the first gas shutoff valve 109, and the primary-side switching mechanism 72, and a liquid side connected to the second refrigerant pipe 114 provided with the primary-side second expansion valve 102.

The primary-side heat exchanger 74 is a device for exchanging heat between the primary-side refrigerant and outdoor air. A gas side of the primary-side heat exchanger 74 is connected to a pipe extending from the primary-side switching mechanism 72. Examples of the primary-side heat exchanger 74 include a fin-and-tube heat exchanger constituted by a plurality of heat transfer tubes and a fin.

The primary-side first expansion valve 76 is provided in a liquid pipe extending from a liquid side of the primary-side heat exchanger 74 to the primary-side subcooling heat exchanger 103. The primary-side first expansion valve 76 is an electric expansion valve capable of adjusting an opening degree for adjusting a flow rate of the primary-side refrigerant flowing through a liquid side portion of the primary-side refrigerant circuit 5*a* and the like.

The primary-side subcooling circuit 104 branches from between the primary-side first expansion valve 76 and the primary-side subcooling heat exchanger 103, and is connected to a portion of the suction flow path between the primary-side switching mechanism 72 and the primary-side accumulator 105. The primary-side subcooling expansion valve 104*a* is provided on an upstream side of the primary-side subcooling heat exchanger 103 in the primary-side subcooling circuit 104, and is an electric expansion valve capable of adjusting an opening degree for adjusting a flow rate of the primary-side refrigerant and the like.

The primary-side subcooling heat exchanger 103 is a heat exchanger that exchanges heat between the refrigerant flowing from the primary-side first expansion valve 76 toward the first liquid shutoff valve 108 and the refrigerant decompressed by the primary-side subcooling expansion valve 104*a* in the primary-side subcooling circuit 104.

The primary-side first connection pipe 111 is a pipe that connects the first liquid shutoff valve 108 and the second liquid shutoff valve 106, and connects the primary-side unit 5 and the heat source unit 2.

The primary-side second connection pipe 112 is a pipe that connects the first gas shutoff valve 109 and the second gas shutoff valve 107, and connects the primary-side unit 5 and the heat source unit 2.

The second refrigerant pipe 114 is a pipe extending from the liquid side of the primary-side flow path 35*b* of the cascade heat exchanger 35 to the second liquid shutoff valve 106.

The primary-side second expansion valve 102 is provided in the second refrigerant pipe 114. The primary-side second expansion valve 102 is an electric expansion valve capable of adjusting an opening degree for adjusting a flow rate of the primary-side refrigerant flowing through the primary-side flow path 35*b* of the cascade heat exchanger 35 and the like.

The first refrigerant pipe 113 is a pipe extending from the gas side of the primary-side flow path 35*b* of the cascade heat exchanger 35 to the second gas shutoff valve 107.

The first gas shutoff valve 109 is provided between the primary-side second connection pipe 112 and the primary-side switching mechanism 72.

(3) Secondary-Side Refrigerant Circuit

The secondary-side refrigerant circuit 10 is configured by connecting the plurality of utilization units 3*a*, 3*b*, and 3*c*, the plurality of branch units 6*a*, 6*b*, and 6*c*, and the heat source unit 2 to each other. The utilization units 3*a*, 3*b*, and 3*c* are connected one-to-one with the corresponding branch units 6*a*, 6*b*, and 6*c*. Specifically, the utilization unit 3*a* and the branch unit 6*a* are connected via the first connection pipe 15*a* and the second connection pipe 16*a*, the utilization unit 3*b* and the branch unit 6*b* are connected via the first connection pipe 15*b* and the second connection pipe 16*b*, and the utilization unit 3*c* and the branch unit 6*c* are connected via the first connection pipe 15*c* and the second connection pipe 16*c*. Further, each of the branch units 6*a*, 6*b*, and 6*c* is connected to the heat source unit 2 via the secondary-side third connection pipe 7, the secondary-side first connection pipe 8, and the secondary-side second connection pipe 9, which are three connection pipes. Specifically, each of the secondary-side third connection pipe 7, the secondary-side first connection pipe 8, and the secondary-side second connection pipe 9 extending from the heat source unit 2 branches into a plurality of pipes and is connected to each of the branch units 6*a*, 6*b*, and 6*c*.

Either a refrigerant in a gas-liquid two-phase state or a refrigerant in a gas state flows through the secondary-side first connection pipe 8 in accordance with an operating state. Note that depending on a type of the second refrigerant, a refrigerant in a supercritical state flows through the secondary-side first connection pipe 8 according to the operating state. Either the refrigerant in the gas-liquid two-phase state or the refrigerant in the gas state flows through the secondary-side second connection pipe 9 in accordance with the operating state. Either the refrigerant in the gas-liquid two-phase state or a refrigerant in a liquid state flows through the secondary-side third connection pipe 7 according to the operating state. Note that depending on the type of the second refrigerant, the refrigerant in the supercritical state flows in the secondary-side third connection pipe 7 according to the operating state.

The secondary-side refrigerant circuit 10 includes a heat source circuit 12, branch circuits 14*a*, 14*b*, and 14*c*, and utilization circuits 13*a*, 13*b*, and 13*c* connected to each other.

The heat source circuit 12 mainly includes a secondary-side compressor 21 (corresponding to a second compressor), the secondary-side switching mechanism 22 (corresponding to a second switching mechanism), a first heat source pipe 28, a second heat source pipe 29, a suction flow path 23, a discharge flow path 24, the third heat source pipe 25, the fourth heat source pipe 26, a fifth heat source pipe 27, the cascade heat exchanger 35, the heat source-side expansion valve 36, a third shutoff valve 31, a first shutoff valve 32, a second shutoff valve 33, a secondary-side accumulator 30, an oil separator 34, an oil return circuit 40, a secondary-side receiver 45, a bypass circuit 46, a bypass expansion valve 46*a*, a secondary-side subcooling heat exchanger 47, a secondary-side subcooling circuit 48, and a secondary-side subcooling expansion valve 48*a*. The heat source circuit 12 of the secondary-side refrigerant circuit 10 specifically includes the secondary-side flow path 35*a* (corresponding to a second portion) of the cascade heat exchanger 35.

The secondary-side compressor 21 is a device for compressing a secondary-side refrigerant, and includes, for example, a scroll type or other positive displacement compressor whose operating capacity can be varied by controlling an inverter for a compressor motor 21*a*. Note that the secondary-side compressor 21 is controlled such that the operating capacity increases as a load increases according to the load during operation.

The secondary-side switching mechanism 22 is a mechanism capable of switching a connection state of the secondary-side refrigerant circuit 10, particularly, a refrigerant flow path in the heat source circuit 12. In the present embodiment, the secondary-side switching mechanism 22 includes a discharge-side connection portion 22*x*, a suction-side connection portion 22*y* (corresponding to a portion on the suction flow path side), a first switching valve 22*a* (corresponding to a four-way switching valve), and a second switching valve 22*b* (corresponding to a four-way switching valve). An end of the discharge flow path 24 on a side opposite to the secondary-side compressor 21 side is connected to the discharge-side connection portion 22*x*. An end of the suction flow path 23 on a side opposite to the secondary-side compressor 21 side is connected to the suction-side connection portion 22*y*. The first switching valve 22*a* and the second switching valve 22*b* are provided in parallel to each other between the discharge flow path 24 and the suction flow path 23 of the secondary-side compressor 21. The first switching valve 22*a* is connected to one end of the discharge-side connection portion 22*x* and one end of the suction-side connection portion 22*y*. The second switching valve 22*b* is connected to another end of the discharge-side connection portion 22*x* and another end of the suction-side connection portion 22*y*. In the present embodiment, each of the first switching valve 22*a* and the second switching valve 22*b* includes the four-way switching valve. Each of the first switching valve 22*a* and the second switching valve 22*b* has four connection ports of a first connection port, a second connection port, a third connection port, and a fourth connection port. In the first switching valve 22*a* and the second switching valve 22*b* of the present embodiment, each of the fourth ports is closed and is a connection port not connected to the flow path of the secondary-side refrigerant circuit 10. In the first switching valve 22*a*, the first connection port is connected to the one end of the discharge-side connection portion 22*x*, the second connection port is connected to the third heat source pipe 25 extending from the secondary-side flow path 35*a* of the cascade heat exchanger 35, and the third connection port is connected to the one end of the suction-side connection portion 22*y*. The first switching valve 22*a* switches between a switching state in which the first connection port and the second connection port are connected and the third connection port and the fourth connection port are connected and a switching state in which the third connection port and the second connection port are connected and the first connection port and the fourth connection port are connected. The second switching valve 22*b* has the first connection port connected to the other end of the discharge-side connection portion 22*x*, the second connection port connected to the first heat source pipe 28, and the third connection port connected to the other end of the suction-side connection portion 22*y*. The second switching valve 22*b* switches between a switching state in which the first connection port and the second connection port are connected and the third connection port and the fourth connection port are connected and a switching state in which the third connection port and the second connection port are connected and the first connection port and the fourth connection port are connected.

When sending of the secondary-side refrigerant discharged from the secondary-side compressor 21 to the secondary-side first connection pipe 8 is suppressed while the cascade heat exchanger 35 is caused to function as a radiator for the secondary-side refrigerant, the secondary-side switching mechanism 22 is switched to a first connection state in which the discharge flow path 24 and the third heat source pipe 25 are connected by the first switching valve 22*a* and the first heat source pipe 28 and the suction flow path 23 are connected by the second switching valve 22*b*. The first connection state of the secondary-side switching mechanism 22 is a connection state adopted during the cooling operation described later. Further, when the cascade heat exchanger 35 functions as an evaporator for the secondary-side refrigerant, the secondary-side switching mechanism 22 is switched to a second connection state in which the discharge flow path 24 and the first heat source pipe 28 are connected by the second switching valve 22*b* and the third heat source pipe 25 and the suction flow path 23 are connected by the first switching valve 22*a*. The second connection state of the secondary-side switching mechanism 22 is a connection state adopted during the heating operation and during the heating main operation described later. Further, when the secondary-side refrigerant discharged from the secondary-side compressor 21 is sent to the secondary-side first connection pipe 8 while the cascade heat exchanger 35 is caused to function as a radiator for the secondary-side refrigerant, the secondary-side switching mechanism 22 is switched to a third connection state in which the discharge flow path 24 and the third heat source pipe 25 are connected by the first switching valve 22*a* and the discharge flow path 24 and the first heat source pipe 28 are connected by the second switching valve 22*b*. The third connection state of the secondary-side switching mechanism 22 is a connection state adopted during the cooling main operation described later.

Figure 7:
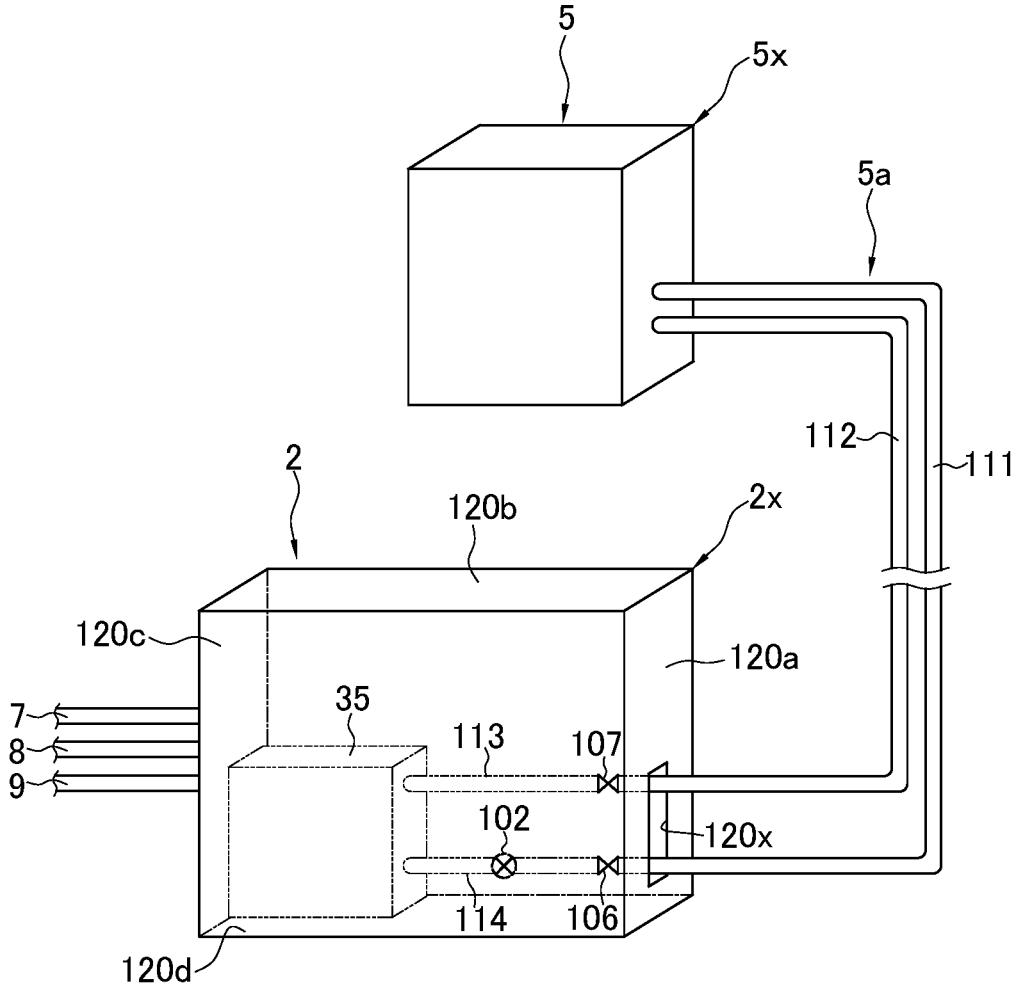
FIG. 7 is a schematic view illustrating a state in which a primary-side unit and a heat source unit are connected.

As described above, the cascade heat exchanger 35 is a device for exchanging heat between the refrigerant such as R32 which is the primary-side refrigerant and the refrigerant such as carbon dioxide which is the secondary-side refrigerant without being mixed with each other. Note that the cascade heat exchanger 35 includes the secondary-side flow path 35*a* through which the secondary-side refrigerant of the secondary-side refrigerant circuit 10 flows and the primary-side flow path 35*b* through which the primary-side refrigerant of the primary-side refrigerant circuit 5*a* flows, and thus is shared by the primary-side unit 5 and the heat source unit 2. Note that in the present embodiment, as shown in FIG. 7, the cascade heat exchanger 35 is disposed inside a heat source casing 2*x* of the heat source unit 2. The gas side of the primary-side flow path 35*b* of the cascade heat exchanger 35 extends to the primary-side second connection pipe 112 outside the heat source casing 2*x* via the first refrigerant pipe 113 and the second gas shutoff valve 107. The liquid side of the primary-side flow path 35*b* of the cascade heat exchanger 35 extends to the primary-side first connection pipe 111 outside the heat source casing 2*x* via the second refrigerant pipe 114 provided with the primary-side second expansion valve 102 and the second liquid shutoff valve 106.

The heat source-side expansion valve 36 is an electric expansion valve connected to the liquid side of the cascade heat exchanger 35 and capable of adjusting an opening degree for adjusting a flow rate of the secondary-side refrigerant flowing through the cascade heat exchanger 35 and the like. The heat source-side expansion valve 36 is provided in the fourth heat source pipe 26.

The third shutoff valve 31, the first shutoff valve 32, and the second shutoff valve 33 are valves provided at connecting ports with external devices and pipes (specifically, the connection pipes 7, 8, and 9). Specifically, the third shutoff valve 31 is connected to the secondary-side third connection pipe 7 drawn out from the heat source unit 2. The first shutoff valve 32 is connected to the secondary-side first connection pipe 8 drawn out from the heat source unit 2. The second shutoff valve 33 is connected to the secondary-side second connection pipe 9 drawn out from the heat source unit 2.

The first heat source pipe 28 is a refrigerant pipe that connects the first shutoff valve 32 and the secondary-side switching mechanism 22. Specifically, the first heat source pipe 28 connects the first shutoff valve 32 and the second connection port of the second switching valve 22*b* of the secondary-side switching mechanism 22.

The suction flow path 23 is a flow path that connects the secondary-side switching mechanism 22 and a suction side of the secondary-side compressor 21. Specifically, the suction flow path 23 connects the suction-side connection portion 22*y* of the secondary-side switching mechanism 22 and the suction side of the secondary-side compressor 21. The secondary-side accumulator 30 is provided in the middle of the suction flow path 23.

The second heat source pipe 29 is a refrigerant pipe connecting the second shutoff valve 33 and the middle of the suction flow path 23. Note that, in the present embodiment, the second heat source pipe 29 is connected to the suction flow path 23 at a connection point of the suction flow path 23 between the suction-side connection portion 22*y* of the secondary-side switching mechanism 22 and the secondary-side accumulator 30.

The discharge flow path 24 is a refrigerant pipe that connects a discharge side of the secondary-side compressor 21 and the secondary-side switching mechanism 22. Specifically, the discharge flow path 24 connects the discharge side of the secondary-side compressor 21 and the discharge-side connection portion 22*x* of the secondary-side switching mechanism 22.

The third heat source pipe 25 is a refrigerant pipe that connects the secondary-side switching mechanism 22 and the gas side of the cascade heat exchanger 35. Specifically, the third heat source pipe 25 connects the second connection port of the first switching valve 22*a* of the secondary-side switching mechanism 22 and a gas-side end of the secondary-side flow path 35*a* in the cascade heat exchanger 35.

The fourth heat source pipe 26 is a refrigerant pipe that connects the liquid side (the side opposite to the gas side, the side opposite to the side on which the secondary-side switching mechanism 22 is provided) of the cascade heat exchanger 35 and the secondary-side receiver 45. Specifically, the fourth heat source pipe 26 connects a liquid-side end (an end on a side opposite to the gas side) of the secondary-side flow path 35*a* in the cascade heat exchanger 35 and the secondary-side receiver 45.

The secondary-side receiver 45 is a refrigerant container that stores a surplus refrigerant in the secondary-side refrigerant circuit 10. The fourth heat source pipe 26, the fifth heat source pipe 27, and the bypass circuit 46 extend from the secondary-side receiver 45.

The bypass circuit 46 is a refrigerant pipe that connects a gas phase region, which is an upper region inside the secondary-side receiver 45, and the suction flow path 23. Specifically, the bypass circuit 46 is connected between the secondary-side switching mechanism 22 and the secondary-side accumulator 30 in the suction flow path 23. The bypass circuit 46 is provided with the bypass expansion valve 46*a*. The bypass expansion valve 46*a* is an electric expansion valve capable of adjusting an amount of a refrigerant guided from the inside of the secondary-side receiver 45 to the suction side of the secondary-side compressor 21 by adjusting an opening degree.

The fifth heat source pipe 27 is a refrigerant pipe connecting the secondary-side receiver 45 and the third shutoff valve 31.

The secondary-side subcooling circuit 48 is a refrigerant pipe that connects a part of the fifth heat source pipe 27 and the suction flow path 23. Specifically, the secondary-side subcooling circuit 48 is connected between the secondary-side switching mechanism 22 and the secondary-side accumulator 30 in the suction flow path 23. Note that, in the present embodiment, the secondary-side subcooling circuit 48 extends so as to branch from between the secondary-side receiver 45 and the secondary-side subcooling heat exchanger 47.

The secondary-side subcooling heat exchanger 47 is a heat exchanger for exchanging heat between a refrigerant flowing through a flow path belonging to the fifth heat source pipe 27 and a refrigerant flowing through a flow path belonging to the secondary-side subcooling circuit 48. In the present embodiment, the secondary-side subcooling heat exchanger 47 is provided between a point where the secondary-side subcooling circuit 48 branches and the third shutoff valve 31 in the fifth heat source pipe 27. The secondary-side subcooling expansion valve 48*a* is provided between a branching point from the fifth heat source pipe 27 in the secondary-side subcooling circuit 48 and the secondary-side subcooling heat exchanger 47. The secondary-side subcooling expansion valve 48*a* supplies a decompressed refrigerant to the secondary-side subcooling heat exchanger 47, and is an electric expansion valve whose opening degree is adjustable.

The secondary-side accumulator 30 is a container capable of storing the secondary-side refrigerant, and is provided on the suction side of the secondary-side compressor 21.

The oil separator 34 is provided in the middle of the discharge flow path 24. The oil separator 34 is a device for separating refrigerating machine oil discharged from the secondary-side compressor 21 along with the secondary-side refrigerant from the secondary-side refrigerant and returning the refrigerating machine oil to the secondary-side compressor 21.

The oil return circuit 40 is provided to connect the oil separator 34 and the suction flow path 23. The oil return circuit 40 includes an oil return flow path 41 extending such that a flow path extending from the oil separator 34 joins a portion of the suction flow path 23 between the secondary-side accumulator 30 and the suction side of the secondary-side compressor 21. An oil return capillary tube 42 and an oil return on-off valve 44 are provided in the middle of the oil return flow path 41. When the oil return on-off valve 44 is controlled to an open state, the refrigerating machine oil separated in the oil separator 34 passes through the oil return capillary tube 42 of the oil return flow path 41 and is returned to the suction side of the secondary-side compressor 21. Here, in the present embodiment, when the secondary-side compressor 21 is in an operating state in the secondary-side refrigerant circuit 10, the oil return on-off valve 44 repeats maintaining the open state for a predetermined time and maintaining a closed state for a predetermined time, thereby controlling an amount of refrigerating machine oil returned through the oil return circuit 40. In the present embodiment, the oil return on-off valve 44 is an electromagnetic valve that is controlled to open and close. However, the oil return capillary tube 42 may be omitted while the oil return on-off valve is an electric expansion valve that can adjust an opening degree.

Hereinafter, the utilization circuits 13*a*, 13*b*, and 13*c* will be described. Since configurations of the utilization circuits 13*b* and 13*c* are similar to a configuration of the utilization circuit 13*a*, for the utilization circuits 13*b* and 13*c*, instead of a subscript "a" indicating each part of the utilization circuit 13*a*, a subscript "b" or "c" is added, and description of each part will be omitted.

The utilization circuit 13*a* mainly includes a utilization-side heat exchanger 52*a* (corresponding to a second heat exchanger), a first utilization pipe 57*a*, a second utilization pipe 56*a*, and a utilization-side expansion valve 51*a*.

The utilization-side heat exchanger 52*a* is a device for exchanging heat between a refrigerant and indoor air, and includes, for example, a fin-and-tube heat exchanger including a large number of heat transfer tubes and a fin. Note that the plurality of utilization-side heat exchangers 52*a*, 52*b*, and 52*c* is connected in parallel to the secondary-side switching mechanism 22, the suction flow path 23, and the cascade heat exchanger 35.

One end of the second utilization pipe 56*a* is connected to a liquid side (a side opposite to a gas side) of the utilization-side heat exchanger 52*a* of the first utilization unit 3*a*. Another end of the second utilization pipe 56*a* is connected to the second connection pipe 16*a*. The utilization-side expansion valve 51*a* described above is provided in the middle of the second utilization pipe 56*a*.

The utilization-side expansion valve 51*a* is an electric expansion valve capable of adjusting an opening degree for adjusting a flow rate of a refrigerant flowing through the utilization-side heat exchanger 52*a* and the like. The utilization-side expansion valve 51*a* is provided in the second utilization pipe 56*a*.

One end of the first utilization pipe 57*a* is connected to the gas side of the utilization-side heat exchanger 52*a* of the first utilization unit 3*a*. In the present embodiment, the first utilization pipe 57*a* is connected to the utilization-side heat exchanger 52*a* on a side opposite to the utilization-side expansion valve 51*a* side. Another end of the first utilization pipe 57*a* is connected to the first connection pipe 15*a*.

Hereinafter, the branch circuits 14*a*, 14*b*, and 14*c* will be described. Since configurations of the branch circuits 14*b* and 14*c* are similar to a configuration of the branch circuit 14*a*, for the branch circuits 14*b* and 14*c*, instead of a subscript "a" indicating each part of the branch circuit 14*a*, a subscript "b" or "c" is added, and description of each part will be omitted.

The branch circuit 14*a* mainly includes a junction pipe 62*a*, a first branch pipe 63*a*, a second branch pipe 64*a*, a first control valve 66*a*, a second control valve 67*a*, a bypass pipe 69*a*, a check valve 68*a*, and a third branch pipe 61*a*.

One end of the junction pipe 62*a* is connected to the first connection pipe 15*a*. The first branch pipe 63*a* and the second branch pipe 64*a* are branched and connected to another end of the junction pipe 62*a*.

The first branch pipe 63*a* is connected to the secondary-side first connection pipe 8 on a side opposite to the junction pipe 62*a* side. The first branch pipe 63*a* is provided with the openable and closable first control valve 66*a*.

The second branch pipe 64*a* is connected to the secondary-side second connection pipe 9 on the side opposite to the junction pipe 62*a* side. The second branch pipe 64*a* is provided with the openable and closable second control valve 67*a*.

The bypass pipe 69*a* is a refrigerant pipe that connects a portion of the first branch pipe 63*a* closer to the secondary-side first connection pipe 8 side than the first control valve 66*a* and a portion of the second branch pipe 64*a* closer to the secondary-side second connection pipe 9 side than the second control valve 67*a*. The check valve 68*a* is provided in the middle of this bypass pipe 69*a*. The check valve 68*a* allows only a refrigerant flow from the second branch pipe 64*a* side toward the first branch pipe 63*a* side, and does not allow a refrigerant flow from the first branch pipe 63*a* side toward the second branch pipe 64*a* side.

One end of the third branch pipe 61*a* is connected to the second connection pipe 16*a*. Another end of the third branch pipe 61*a* is connected to the secondary-side third connection pipe 7.

The first branch unit 6*a* can function as follows by closing the first control valve 66*a* and opening the second control valve 67*a* when performing the cooling operation to be described later. The first branch unit 6*a* sends a refrigerant flowing into the third branch pipe 61*a* through the secondary-side third connection pipe 7 to the second connection pipe 16*a*. Note that the refrigerant flowing through the second utilization pipe 56*a* of the first utilization unit 3*a* through the second connection pipe 16*a* is sent to the utilization-side heat exchanger 52*a* of the first utilization unit 3*a* through the utilization-side expansion valve 51*a*. Then, the refrigerant sent to the utilization-side heat exchanger 52*a* evaporates by heat exchange with indoor air, and then flows through the first connection pipe 15*a* via the first utilization pipe 57*a*. The refrigerant having flowed through the first connection pipe 15*a* is sent to the junction pipe 62*a* of the first branch unit 6*a*. The refrigerant having flowed through the junction pipe 62*a* does not flow toward the first branch pipe 63*a* side but flows toward the second branch pipe 64*a* side. The refrigerant flowing through the second branch pipe 64*a* passes through the second control valve 67*a*. A part of the refrigerant that has passed through the second control valve 67*a* is sent to the secondary-side second connection pipe 9. Further, a remaining part of the refrigerant that has passed through the second control valve 67*a* flows so as to branch into the bypass pipe 69*a* provided with the check valve 68*a*, passes through a part of the first branch pipe 63*a*, and then is sent to the secondary-side first connection pipe 8. As a result, it is possible to increase a total flow path cross-sectional area when the secondary-side gas state refrigerant evaporated in the utilization-side heat exchanger 52*a* is sent to the secondary-side compressor 21, so that pressure loss can be reduced.

In addition, when the first utilization unit 3*a* cools a room at the time of performing the cooling main operation and the heating main operation to be described later, the first branch unit 6*a* can function as follows by closing the first control valve 66*a* and opening the second control valve 67*a*. The first branch unit 6*a* sends a refrigerant flowing into the third branch pipe 61*a* through the secondary-side third connection pipe 7 to the second connection pipe 16*a*. Note that the refrigerant flowing through the second utilization pipe 56*a* of the first utilization unit 3*a* through the second connection pipe 16*a* is sent to the utilization-side heat exchanger 52*a* of the first utilization unit 3*a* through the utilization-side expansion valve 51*a*. Then, the refrigerant sent to the utilization-side heat exchanger 52*a* evaporates by heat exchange with indoor air, and then flows through the first connection pipe 15*a* via the first utilization pipe 57*a*. The refrigerant having flowed through the first connection pipe 15*a* is sent to the junction pipe 62*a* of the first branch unit 6*a*. The refrigerant having flowed through the junction pipe 62*a* flows to the second branch pipe 64*a*, passes through the second control valve 67*a*, and then is sent to the secondary-side second connection pipe 9.

In addition, the first branch unit 6*a* can function as follows by closing the second control valve 67*a* and opening the first control valve 66*a* when performing the heating operation to be described later. In the first branch unit 6*a*, the refrigerant flowing into the first branch pipe 63*a* through the secondary-side first connection pipe 8 passes through the first control valve 66*a* and is sent to the junction pipe 62*a*. The refrigerant having flowed through the junction pipe 62*a* flows through the first utilization pipe 57*a* of the utilization unit 3*a* via the first connection pipe 15*a* and is sent to the utilization-side heat exchanger 52*a*. Then, the refrigerant sent to the utilization-side heat exchanger 52*a* radiates heat by heat exchange with indoor air, and then passes through the utilization-side expansion valve 51*a* provided in the second utilization pipe 56*a*. The refrigerant having passed through the second utilization pipe 56*a* flows through the third branch pipe 61*a* of the first branch unit 6*a* via the second connection pipe 16*a*, and then is sent to the secondary-side third connection pipe 7.

In addition, when the first utilization unit 3*a* heats a room at the time of performing the cooling main operation and the heating main operation to be described later, the first branch unit 6*a* can function as follows by closing the second control valve 67*a* and opening the first control valve 66*a*. In the first branch unit 6*a*, the refrigerant flowing into the first branch pipe 63*a* through the secondary-side first connection pipe 8 passes through the first control valve 66*a* and is sent to the junction pipe 62*a*. The refrigerant having flowed through the junction pipe 62*a* flows through the first utilization pipe 57*a* of the utilization unit 3*a* via the first connection pipe 15*a* and is sent to the utilization-side heat exchanger 52*a*. Then, the refrigerant sent to the utilization-side heat exchanger 52*a* radiates heat by heat exchange with indoor air, and then passes through the utilization-side expansion valve 51*a* provided in the second utilization pipe 56*a*. The refrigerant having passed through the second utilization pipe 56*a* flows through the third branch pipe 61*a* of the first branch unit 6*a* via the second connection pipe 16*a*, and then is sent to the secondary-side third connection pipe 7.

Such a function is provided not only in the first branch unit 6*a* but also in the second branch unit 6*b* and the third branch unit 6*c*. Therefore, each of the first branch unit 6*a*, the second branch unit 6*b*, and the third branch unit 6*c* can individually switch whether each of the utilization-side heat exchangers 52*a*, 52*b*, and 52*c* functions as a refrigerant evaporator or a refrigerant radiator.

(4) Primary-Side Unit

The primary-side unit 5 is installed in a space, on a rooftop, or the like different from a space in which the utilization units 3*a*, 3*b*, and 3*c* and the branch units 6*a*, 6*b*, and 6*c* are arranged.

The primary-side unit 5 includes a part of the above-described primary-side refrigerant circuit 5*a*, a primary-side fan 75, various sensors, a primary-side control unit 70, and a primary-side casing 5*x* as shown in FIG. 7.

The primary-side unit 5 includes, as a part of the primary-side refrigerant circuit 5*a*, the primary-side compressor 71, the primary-side switching mechanism 72, the primary-side heat exchanger 74, the primary-side first expansion valve 76, the primary-side subcooling heat exchanger 103, the primary-side subcooling circuit 104, the primary-side subcooling expansion valve 104*a*, the first liquid shutoff valve 108, the first gas shutoff valve 109, and the primary-side accumulator 105 in the primary-side casing 5*x*.

The primary-side fan 75 is provided in the primary-side unit 5, and generates an air flow that guides outdoor air to the primary-side heat exchanger 74, exchanges heat with a primary-side refrigerant flowing through the primary-side heat exchanger 74, and then discharges the air to the outside. The primary-side fan 75 is driven by a primary-side fan motor 75*a*.

Further, the primary-side unit 5 is provided with various sensors. Specifically, an outdoor air temperature sensor 77 that detects temperature of outdoor air before passing through the primary-side heat exchanger 74, a primary-side discharge pressure sensor 78 that detects pressure of the primary-side refrigerant discharged from the primary-side compressor 71, a primary-side suction pressure sensor 79 that detects pressure of the primary-side refrigerant sucked into the primary-side compressor 71, a primary-side suction temperature sensor 81 that detects temperature of the primary-side refrigerant sucked into the primary-side compressor 71, and a primary-side heat-exchange temperature sensor 82 that detects temperature of a refrigerant flowing through the primary-side heat exchanger 74 are provided.

The primary-side control unit 70 controls operations of the units 71 (71*a*), 72, 75 (75*a*), 76, and 104*a* provided in the primary-side unit 5. The primary-side control unit 70 includes a processor such as a CPU or a microcomputer and a memory provided to control the primary-side unit 5. The primary-side control unit can exchange control signals and the like with a remote controller (not illustrated), and exchange control signals and the like with a heat source-side control unit 20 of the heat source unit 2, branch unit control units 60*a*, 60*b*, and 60*c*, and utilization-side control units 50*a*, 50*b*, and 50*c*.

(5) Heat Source Unit

The heat source unit 2 is installed in a space, on a rooftop, or the like different from the space in which the utilization units 3*a*, 3*b*, and 3*c* and the branch units 6*a*, 6*b*, and 6*c* are disposed.

The heat source unit 2 is connected to the branch units 6*a*, 6*b*, and 6*c* via the connection pipes 7, 8, and 9, and constitutes a part of the secondary-side refrigerant circuit 10. Further, the heat source unit 2 is connected to the primary-side unit 5 via the primary-side first connection pipe 111 and the primary-side second connection pipe 112, and constitutes a part of the primary-side refrigerant circuit 5*a*.

The heat source unit 2 mainly includes the heat source circuit 12 described above, various sensors, the heat source-side control unit 20, the second liquid shutoff valve 106, the second refrigerant pipe 114, the primary-side second expansion valve 102, the first refrigerant pipe 113, and the second gas shutoff valve 107 that constitute a part of the primary-side refrigerant circuit 5*a*, and the heat source casing 2*x* as illustrated in FIG. 7.

The heat source unit 2 includes a secondary-side suction pressure sensor 37 that detects pressure of a secondary-side refrigerant on the suction side of the secondary-side compressor 21, a secondary-side discharge pressure sensor 38 that detects pressure of the secondary-side refrigerant on the discharge side of the secondary-side compressor 21, a secondary-side discharge temperature sensor 39 that detects temperature of the secondary-side refrigerant on the discharge side of the secondary-side compressor 21, a secondary-side suction temperature sensor 88 that detects temperature of the secondary-side refrigerant on the suction side of the secondary-side compressor 21, a secondary-side cascade temperature sensor 83 that detects temperature of the secondary-side refrigerant flowing between the secondary-side flow path 35*a* of the cascade heat exchanger 35 and the heat source-side expansion valve 36, a receiver outlet temperature sensor 84 that detects temperature of the secondary-side refrigerant flowing between the secondary-side receiver 45 and the secondary-side subcooling heat exchanger 47, a bypass circuit temperature sensor 85 that detects temperature of the secondary-side refrigerant flowing downstream of the bypass expansion valve 46*a* in the bypass circuit 46, a subcooling outlet temperature sensor 86 that detects temperature of the secondary-side refrigerant flowing between the secondary-side subcooling heat exchanger 47 and the third shutoff valve 31, and a subcooling circuit temperature sensor 87 that detects temperature of the secondary-side refrigerant flowing through an outlet of the secondary-side subcooling heat exchanger 47 in the secondary-side subcooling circuit 48.

The heat source-side control unit 20 controls operations of the units 21 (21*a*), 22, 36, 44, 46*a*, 48*a*, and 102 provided inside the heat source casing 2*x* of the heat source unit 2. The heat source-side control unit 20 includes a processor such as a CPU or a microcomputer and a memory provided to control the heat source unit 2. The heat source control unit can exchange control signals and the like with the primary-side control unit 70 of the primary-side unit 5, the utilization-side control units 50*a*, 50*b*, and 50*c* of the utilization units 3*a*, 3*b*, and 3*c*, and the branch unit control units 60*a*, 60*b*, and 60*c*.

As described above, the heat source-side control unit 20 can control not only the units constituting the heat source circuit 12 of the secondary-side refrigerant circuit 10 but also the primary-side second expansion valve 102 constituting a part of the primary-side refrigerant circuit 5*a*. Therefore, the heat source-side control unit 20 controls a valve opening degree of the primary-side second expansion valve 102 based on a condition of the heat source circuit 12 controlled by the heat source-side control unit 20, thereby bringing the condition of the heat source circuit 12 closer to a desired condition. Specifically, it is possible to control an amount of heat received by the secondary-side refrigerant flowing through the secondary-side flow path 35*a* of the cascade heat exchanger 35 in the heat source circuit 12 from the primary-side refrigerant flowing through the primary-side flow path 35*b* of the cascade heat exchanger 35 or an amount of heat given by the secondary-side refrigerant to the primary-side refrigerant.

(6) Utilization Unit

The utilization units 3*a*, 3*b*, and 3*c* are installed by being embedded, suspended, or the like on a ceiling in a room of a building or the like, or by being hung or the like on a wall surface in the room.

The utilization units 3*a*, 3*b*, and 3*c* are connected to the heat source unit 2 via the connection pipes 7, 8, and 9.

The utilization units 3*a*, 3*b*, and 3*c* include the utilization circuits 13*a*, 13*b*, and 13*c* constituting a part of the secondary-side refrigerant circuit 10.

Configurations of the utilization units 3*a*, 3*b*, and 3*c* will be described below. Note that since the configurations of the second utilization unit 3*b* and the third utilization unit 3*c* are similar to the configuration of the first utilization unit 3*a*, only the configuration of the first utilization unit 3*a* will be described here. For the configurations of the second utilization unit 3*b* and the third utilization unit 3*c*, instead of a subscript "a" indicating each part of the first utilization unit 3*a*, a subscript "b" or "c" is added, respectively, and description of each part will be omitted.

The first utilization unit 3*a* mainly includes the above-described utilization circuit 13*a*, an indoor fan 53*a*, the utilization-side control unit 50*a*, and various sensors. Note that the indoor fan 53*a* includes an indoor fan motor 54*a*.

The indoor fan 53*a* sucks indoor air into the unit, exchanges heat with a refrigerant flowing through the utilization-side heat exchanger 52*a*, and then generates an air flow to be supplied into the room as supply air. The indoor fan 53*a* is driven by then indoor fan motor 54*a*.

The utilization unit 3*a* is provided with a liquid-side temperature sensor 58*a* that detects temperature of the refrigerant on the liquid side of the utilization-side heat exchanger 52*a*. Further, the utilization unit 3*a* is provided with an indoor temperature sensor 55*a* that detects indoor temperature that is temperature of air taken in from the room and before passing through the utilization-side heat exchanger 52*a*.

The utilization-side control unit 50*a* controls operations of the units 51*a* and 53*a* (54*a*) constituting the utilization unit 3*a*. The utilization-side control unit 50*a* includes a processor such as a CPU or a microcomputer and a memory provided to control the utilization unit 3*a*. The utilization-side control unit can exchange control signals and the like with a remote controller (not illustrated), and exchange control signals and the like with the heat source-side control unit 20 of the heat source unit 2, the branch unit control units 60*a*, 60*b*, and 60*c*, and the primary-side control unit 70 of the primary-side unit 5.

Note that the second utilization unit 3*b* includes the utilization circuit 13*b*, an indoor fan 53*b*, the utilization-side control unit 50*b*, and an indoor fan motor 54*b*. The third utilization unit 3*c* includes the utilization circuit 13*c*, an indoor fan 53*c*, the utilization-side control unit 50*c*, and an indoor fan motor 54*c*.

(7) Branch Unit

The branch units 6*a*, 6*b*, and 6*c* are installed in a space or the like in a ceiling cavity of a room of a building or the like.

The branch units 6*a*, 6*b*, and 6*c* are connected to the utilization units 3*a*, 3*b*, and 3*c* in one-to-one correspondence. The branch units 6*a*, 6*b*, and 6*c* are connected to the heat source unit 2 via the connection pipes 7, 8, and 9.

Next, configurations of the branch units 6*a*, 6*b*, and 6*c* will be described. Note that since the configurations of the second branch unit 6*b* and the third branch unit 6*c* are similar to the configuration of the first branch unit 6*a*, only the configuration of the first branch unit 6*a* will be described here. For the configurations of the second branch unit 6*b* and the third branch unit 6*c*, instead of a subscript "a" indicating each part of the first branch unit 6*a*, a subscript "b" or "c" is added, respectively, and description of each part will be omitted.

The first branch unit 6*a* mainly includes the above-described branch circuit 14*a* and the branch unit control unit 60*a*.

The branch unit control unit 60*a* controls operations of the units 66*a* and 67*a* constituting the branch unit 6*a*. The branch unit control unit 60*a* includes a processor such as a CPU or a microcomputer and a memory provided to control the branch unit 6*a*. The branch unit control unit can exchange control signals and the like with a remote controller (not illustrated) and exchange control signals and the like with the heat source-side control unit 20 of the heat source unit 2, the utilization units 3*a*, 3*b*, and 3*c*, and the primary-side control unit 70 of the primary-side unit 5.

Note that the second branch unit 6*b* includes the branch circuit 14*b* and the branch unit control unit 60*b*. The third branch unit 6*c* includes the branch circuit 14*c* and the branch unit control unit 60*c*.

(8) Control Unit

In the refrigeration cycle apparatus 1, the heat source-side control unit 20, the utilization-side control units 50*a*, 50*b*, and 50*c*, the branch unit control units 60*a*, 60*b*, and 60*c*, and the primary-side control unit 70 described above are communicably connected to each other in a wired or wireless manner to constitute a control unit 80. Therefore, this control unit 80 controls operations of the units 21 (21*a*), 22, 36, 44, 46*a*, 48*a*, 51*a*, 51*b*, 51*c*, 53*a*, 53*b*, 53*c* (54*a*, 54*b*, 54*c*), 66*a*, 66*b*, 66*c*, 67*a*, 67*b*, 67*c*, 71 (71*a*), 72, 75 (75*a*), 76, 104*a* on the basis of detection information of the various sensors 37, 38, 39, 83, 84, 85, 86, 87, 88, 77, 78, 79, 81, 82, 58*a*, 58*b*, 58*c*, and the like, and instruction information received from a remote controller (not illustrated) and the like.

(9) Operation of Refrigeration Cycle Apparatus

Next, an operation of the refrigeration cycle apparatus 1 will be described with reference to FIGS. 3 to 6.

Refrigeration cycle operation of the refrigeration cycle apparatus 1 can be mainly divided into cooling operation, heating operation, cooling main operation, and heating main operation.

Here, the cooling operation is refrigeration cycle operation in which only the utilization unit in which the utilization-side heat exchanger functions as a refrigerant evaporator exists, and the cascade heat exchanger 35 functions as a radiator for the secondary-side refrigerant with respect to an evaporation load of the entire utilization unit.

The heating operation is refrigeration cycle operation in which only the utilization unit in which the utilization-side heat exchanger functions as a refrigerant radiator exists, and the cascade heat exchanger 35 functions as an evaporator for the secondary-side refrigerant with respect to a heat radiation load of the entire utilization unit.

The cooling main operation is operation in which the utilization unit in which the utilization-side heat exchanger functions as a refrigerant evaporator and the utilization unit in which the utilization-side heat exchanger functions as a refrigerant radiator are mixed. The cooling main operation is refrigeration cycle operation in which, when an evaporation load is a main thermal load of the entire utilization unit, the cascade heat exchanger 35 functions as a radiator for the secondary-side refrigerant in order to process the evaporation load of the entire utilization unit.

The heating main operation is operation in which the utilization unit in which the utilization-side heat exchanger functions as a refrigerant evaporator and the utilization unit in which the utilization-side heat exchanger functions as a refrigerant radiator are mixed. The heating main operation is refrigeration cycle operation in which, when a heat radiation load is a main heat load of the entire utilization unit, the cascade heat exchanger 35 functions as an evaporator for the secondary-side refrigerant in order to process the heat radiation load of the entire utilization unit.

Note that the operation of the refrigeration cycle apparatus 1 including the refrigeration cycle operation is performed by the above-described control unit 80.

(9-1) Cooling Operation

Figure 3:
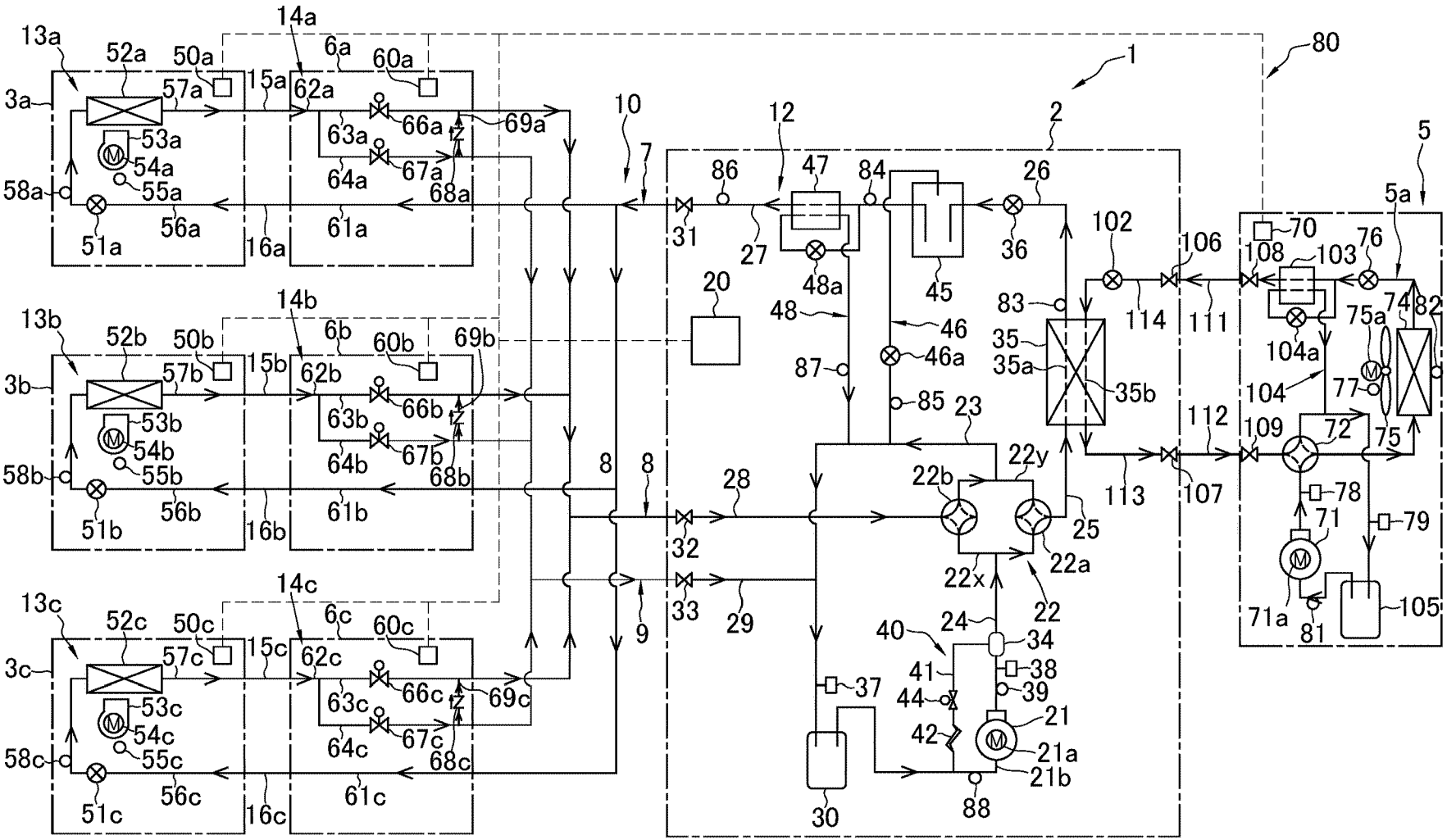
FIG. 3 is a diagram illustrating an operation (a flow of a refrigerant) in cooling operation of the refrigeration cycle apparatus.

In the cooling operation, for example, all of the utilization-side heat exchangers 52*a*, 52*b*, and 52*c* of the utilization units 3*a*, 3*b*, and 3*c* operate to function as refrigerant evaporators, and the cascade heat exchanger 35 operates to function as a radiator for the secondary-side refrigerant. In this cooling operation, the primary-side refrigerant circuit 5*a* and the secondary-side refrigerant circuit 10 of the refrigeration cycle apparatus 1 are configured as illustrated in FIG. 3. Note that arrows attached to the primary-side refrigerant circuit 5*a* and arrows attached to the secondary-side refrigerant circuit 10 in FIG. 3 indicate flows of the refrigerant during the cooling operation.

Specifically, in the primary-side unit 5, the cascade heat exchanger 35 is caused to function as an evaporator for a primary-side refrigerant by switching the primary-side switching mechanism 72 to the fifth connection state. The fifth connection state of the primary-side switching mechanism 72 is a connection state indicated by solid lines in the primary-side switching mechanism 72 of FIG. 3. As a result, in the primary-side unit 5, the primary-side refrigerant discharged from the primary-side compressor 71 passes through the primary-side switching mechanism 72, and is condensed by exchanging heat with outdoor air supplied from the primary-side fan 75 in the primary-side heat exchanger 74. The primary-side refrigerant condensed in the primary-side heat exchanger 74 passes through the primary-side first expansion valve 76 controlled to a fully open state. A part of the refrigerant flows toward the first liquid shutoff valve 108 through the primary-side subcooling heat exchanger 103, and another part of the refrigerant branches and flows into the primary-side subcooling circuit 104. The refrigerant flowing through the primary-side subcooling circuit 104 is decompressed when passing through the primary-side subcooling expansion valve 104*a*. The refrigerant flowing from the primary-side first expansion valve 76 toward the first liquid shutoff valve 108 exchanges heat with the refrigerant decompressed by the primary-side subcooling expansion valve 104*a* and flowing through the primary-side subcooling circuit 104 in the primary-side subcooling heat exchanger 103, and is cooled until reaching a subcooled state. The refrigerant in the subcooled state flows through the primary-side first connection pipe 111, the second liquid shutoff valve 106, and the second refrigerant pipe 114 in this order, and is decompressed when passing through the primary-side second expansion valve 102. Here, a valve opening degree of the primary-side second expansion valve 102 is controlled such that a degree of superheating of the primary-side refrigerant sucked into the primary-side compressor 71 satisfies a predetermined condition. When flowing through the primary-side flow path 35*b* of the cascade heat exchanger 35, the primary-side refrigerant decompressed by the primary-side second expansion valve 102 evaporates by exchanging heat with the secondary-side refrigerant flowing through the secondary-side flow path 35*a*, and flows toward the second gas shutoff valve 107 through the first refrigerant pipe 113. The refrigerant having passed through the second gas shutoff valve 107 passes through the primary-side second connection pipe 112 and the first gas shutoff valve 109, and then reaches the primary-side switching mechanism 72. The refrigerant that has passed through the primary-side switching mechanism 72 joins the refrigerant that has flowed through the primary-side subcooling circuit 104, and is then sucked into the primary-side compressor 71 via the primary-side accumulator 105.

Further, in the heat source unit 2, by switching the secondary-side switching mechanism 22 to the first connection state, the cascade heat exchanger 35 functions as a radiator for the secondary-side refrigerant. Note that, in the first connection state of the secondary-side switching mechanism 22, the discharge flow path 24 and the third heat source pipe 25 are connected by the first switching valve 22*a*, and the first heat source pipe 28 and the suction flow path 23 are connected by the second switching valve 22*b*. Here, an opening degree of the heat source-side expansion valve 36 is adjusted. In the first to third branch units 3*a*, 3*b*, 3*c*, the second control valves 67*a*, 67*b*, 67*c* are controlled to open states. As a result, all of the utilization-side heat exchangers 52*a*, 52*b*, and 52*c* of the utilization units 3*a*, 3*b*, and 3*c* function as refrigerant evaporators. Further, all of the utilization-side heat exchangers 52*a*, 52*b*, and 52*c* of the utilization units 3*a*, 3*b*, and 3*c* and the suction side of the secondary-side compressor 21 of the heat source unit 2 are connected via the first utilization pipes 57*a*, 57*b*, and 57*c*, the first connection pipes 15*a*, 15*b*, and 15*c*, the junction pipes 62*a*, 62*b*, and 62*c*, the second branch pipes 64*a*, 64*b*, and 64*c*, the bypass pipes 69*a*, 69*b*, and 69*c*, parts of the first branch pipes 63*a*, 63*b*, and 63*c*, the secondary-side first connection pipe 8, and the secondary-side second connection pipe 9. In addition, an opening degree of the secondary-side subcooling expansion valve 48*a* is controlled such that a degree of subcooling of the secondary-side refrigerant flowing through the outlet of the secondary-side subcooling heat exchanger 47 toward the secondary-side third connection pipe 7 satisfies a predetermined condition. The bypass expansion valve 46*a* is controlled to a closed state. In the utilization units 3*a*, 3*b*, and 3*c*, opening degrees of the utilization-side expansion valves 51*a*, 51*b*, and 51*c* are adjusted.

In such a secondary-side refrigerant circuit 10, a high-pressure secondary-side refrigerant compressed and discharged by the secondary-side compressor 21 is sent to the secondary-side flow path 35*a* of the cascade heat exchanger 35 through the first switching valve 22*a* of the secondary-side switching mechanism 22. In the cascade heat exchanger 35, the high-pressure secondary-side refrigerant flowing through the secondary-side flow path 35*a* radiates heat, and the primary-side refrigerant flowing through the primary-side flow path 35*b* of the cascade heat exchanger 35 evaporates. The secondary-side refrigerant having radiated heat in the cascade heat exchanger 35 passes through the heat source-side expansion valve 36 whose opening degree is adjusted, and then flows into the secondary-side receiver 45. A part of the refrigerant that has flowed out of the secondary-side receiver 45 branches and flows into the secondary-side subcooling circuit 48, is decompressed by the secondary-side subcooling expansion valve 48*a*, and then joins the suction flow path 23. In the secondary-side subcooling heat exchanger 47, another part of the refrigerant that has flowed out of the secondary-side receiver 45 is cooled by the refrigerant flowing through the secondary-side subcooling circuit 48, and then is sent to the secondary-side third connection pipe 7 through the third shutoff valve 31.

Then, the refrigerant sent to the secondary-side third connection pipe 7 is branched into three and passes through the third branch pipes 61*a*, 61*b*, and 61*c* of the first to third branch units 6*a*, 6*b*, and 6*c*. Thereafter, the refrigerant having flowed through the second connection pipes 16*a*, 16*b*, and 16*c* is sent to the second utilization pipes 56*a*, 56*b*, and 56*c* of the first to third utilization units 3*a*, 3*b*, and 3*c*, respectively. The refrigerant sent to the second utilization pipes 56*a*, 56*b*, and 56*c* is sent to the utilization-side expansion valves 51*a*, 51*b*, and 51*c* of the utilization units 3*a*, 3*b*, and 3*c*.

Then, the refrigerant having passed through the utilization-side expansion valves 51*a*, 51*b*, and 51*c* whose opening degrees are adjusted exchanges heat with indoor air supplied by the indoor fans 53*a*, 53*b*, and 53*c* in the utilization-side heat exchangers 52*a*, 52*b*, and 52*c*. As a result, the refrigerant flowing through the utilization-side heat exchangers 52*a*, 52*b*, and 52*c* evaporates and becomes a low-pressure gas refrigerant. The indoor air is cooled and is supplied into the room. As a result, an indoor space is cooled. The low-pressure gas refrigerant evaporated in the utilization-side heat exchangers 52*a*, 52*b*, and 52*c* flows through the first utilization pipes 57*a*, 57*b*, and 57*c*, flows through the first connection pipes 15*a*, 15*b*, and 15*c*, and then is sent to the junction pipes 62*a*, 62*b*, and 62*c* of the first to third branch units 6*a*, 6*b*, and 6*c*.

Then, the low-pressure gas refrigerant sent to the junction pipes 62*a*, 62*b*, and 62*c* flows to the second branch pipes 64*a*, 64*b*, and 64*c*. A part of the refrigerant that has passed through the second control valves 67*a*, 67*b*, and 67*c* in the second branch pipes 64*a*, 64*b*, and 64*c* is sent to the secondary-side second connection pipe 9. A remaining part of the refrigerant that has passed through the second control valves 67*a*, 67*b*, and 67*c* passes through the bypass pipes 69*a*, 69*b*, and 69*c*, flows through a part of the first branch pipes 63*a*, 63*b*, and 63*c*, and then is sent to the secondary-side first connection pipe 8.

Then, the low-pressure gas refrigerant sent to the secondary-side first connection pipe 8 and the secondary-side second connection pipe 9 is returned to the suction side of the secondary-side compressor 21 through the first shutoff valve 32, the second shutoff valve 33, the first heat source pipe 28, the second heat source pipe 29, the second switching valve 22*b* of the secondary-side switching mechanism 22, the suction flow path 23, and the secondary-side accumulator 30.

Note that, in this cooling operation, the secondary-side refrigerant circuit 10 controls capacity, for example, by controlling the secondary-side compressor 21 so that evaporation temperature of the secondary-side refrigerant in the utilization-side heat exchangers 52*a*, 52*b*, and 52*c* becomes predetermined secondary-side evaporation target temperature. The primary-side refrigerant circuit 5*a* controls capacity, for example, by controlling the primary-side compressor 71 such that evaporation temperature of the primary-side refrigerant in the primary-side flow path 35*b* of the cascade heat exchanger 35 becomes predetermined primary-side evaporation target temperature. Here, the primary-side evaporation target temperature is changed such that a carbon dioxide refrigerant flowing through the secondary-side flow path 35*a* of the cascade heat exchanger 35 does not exceed a critical point when an operation condition is not a predetermined operation condition in which the carbon dioxide refrigerant exceeds the critical point. Also, the primary-side evaporation target temperature is changed such that the carbon dioxide refrigerant exceeds the critical point by more than a predetermined amount when the operation condition is the predetermined operation condition in which the carbon dioxide refrigerant exceeds the critical point.

In this manner, the operation in the cooling operation is performed.

(9-2) Heating Operation

Figure 4:
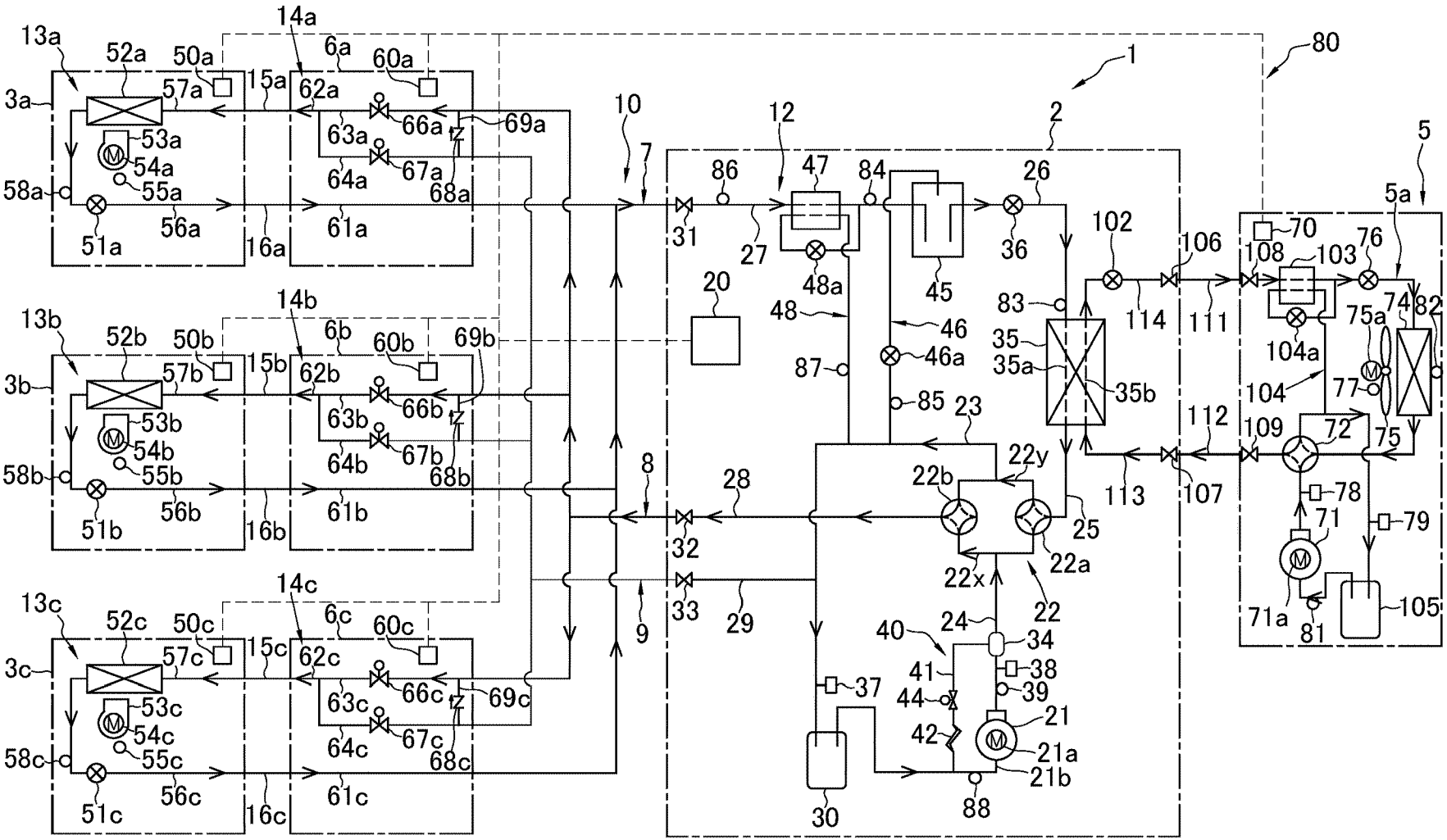
FIG. 4 is a diagram illustrating an operation (a flow of a refrigerant) in heating operation of the refrigeration cycle apparatus.

In the heating operation, for example, all of the utilization-side heat exchangers 52*a*, 52*b*, and 52*c* of the utilization units 3*a*, 3*b*, and 3*c* operate to function as refrigerant radiators. Further, in the heating operation, the cascade heat exchanger 35 operates to function as an evaporator for the secondary-side refrigerant. In the heating operation, the primary-side refrigerant circuit 5*a* and the secondary-side refrigerant circuit 10 of the refrigeration cycle apparatus 1 are configured as illustrated in FIG. 4. Arrows attached to the primary-side refrigerant circuit 5*a* and arrows attached to the secondary-side refrigerant circuit 10 in FIG. 4 indicate flows of the refrigerant during the heating operation.

Specifically, in the primary-side unit 5, by switching the primary-side switching mechanism 72 to the sixth connection state, the cascade heat exchanger 35 functions as a radiator for the primary-side refrigerant. The sixth connection state of the primary-side switching mechanism 72 is a connection state indicated by broken lines in the primary-side switching mechanism 72 in FIG. 4. As a result, in the primary-side unit 5, the primary-side refrigerant discharged from the primary-side compressor 71, passed through the primary-side switching mechanism 72, and passed through the first gas shutoff valve 109 passes through the primary-side second connection pipe 112 and the second gas shutoff valve 107, and is sent to the primary-side flow path 35*b* of the cascade heat exchanger 35. The refrigerant flowing through the primary-side flow path 35*b* of the cascade heat exchanger 35 is condensed by exchanging heat with the secondary-side refrigerant flowing through the secondary-side flow path 35*a*. When flowing through the second refrigerant pipe 114, the primary-side refrigerant condensed in the cascade heat exchanger 35 passes through the primary-side second expansion valve 102 controlled to a fully open state. The refrigerant that has passed through the primary-side second expansion valve 102 flows through the second liquid shutoff valve 106, the primary-side first connection pipe 111, the first liquid shutoff valve 108, and the primary-side subcooling heat exchanger 103 in this order, and is decompressed by the primary-side first expansion valve 76. Note that, during the heating operation, the primary-side subcooling expansion valve 104*a* is controlled to a closed state, so that the refrigerant does not flow into the primary-side subcooling circuit 104. Therefore, heat is not exchanged in the primary-side subcooling heat exchanger 103 either. Note that a valve opening degree of the primary-side first expansion valve 76 is controlled such that, for example, a degree of superheating of the refrigerant sucked into the primary-side compressor 71 satisfies a predetermined condition. The refrigerant decompressed by the primary-side first expansion valve 76 evaporates by exchanging heat with outdoor air supplied from the primary-side fan 75 in the primary-side heat exchanger 74, passes through the primary-side switching mechanism 72 and the primary-side accumulator 105, and is sucked into the primary-side compressor 71.

Further, in the heat source unit 2, the secondary-side switching mechanism 22 is switched to the second connection state. The cascade heat exchanger 35 thus functions as an evaporator for the secondary-side refrigerant. In the second connection state of the secondary-side switching mechanism 22, the discharge flow path 24 and the first heat source pipe 28 are connected by the second switching valve 22*b*, and the third heat source pipe 25 and the suction flow path 23 are connected by the first switching valve 22*a*. Further, an opening degree of the heat source-side expansion valve 36 is adjusted. In the first to third branch units 6*a*, 6*b*, and 6*c*, the first control valves 66*a*, 66*b*, and 66*c* are controlled to open states, and the second control valves 67*a*, 67*b*, and 67*c* are controlled to closed states. As a result, all of the utilization-side heat exchangers 52*a*, 52*b*, and 52*c* of the utilization units 3*a*, 3*b*, and 3*c* function as refrigerant radiators. The utilization-side heat exchangers 52*a*, 52*b*, and 52*c* of the utilization units 3*a*, 3*b*, and 3*c* and the discharge side of the secondary-side compressor 21 of the heat source unit 2 are connected via the discharge flow path 24, the first heat source pipe 28, the secondary-side first connection pipe 8, the first branch pipes 63*a*, 63*b*, and 63*c*, the junction pipes 62*a*, 62*b*, and 62*c*, the first connection pipes 15*a*, 15*b*, and 15*c*, and the first utilization pipes 57*a*, 57*b*, and 57*c*. Further, the secondary-side subcooling expansion valve 48*a* and the bypass expansion valve 46*a* are controlled to closed states. In the utilization units 3*a*, 3*b*, and 3*c*, opening degrees of the utilization-side expansion valves 51*a*, 51*b*, and 51*c* are adjusted.

In such a secondary-side refrigerant circuit 10, the high-pressure refrigerant compressed and discharged by the secondary-side compressor 21 is sent to the first heat source pipe 28 through the second switching valve 22*b* of the secondary-side switching mechanism 22. The refrigerant sent to the first heat source pipe 28 is sent to the secondary-side first connection pipe 8 through the first shutoff valve 32.

Then, the high-pressure refrigerant sent to the secondary-side first connection pipe 8 is branched into three and is sent to the first branch pipes 63*a*, 63*b*, and 63*c* of the utilization units 3*a*, 3*b*, and 3*c*, which are the utilization units in operation. The high-pressure refrigerant sent to the first branch pipes 63*a*, 63*b*, and 63*c* passes through the first control valves 66*a*, 66*b*, and 66*c*, and flows through the junction pipes 62*a*, 62*b*, and 62*c*. Thereafter, the refrigerant having flowed through the first connection pipes 15*a*, 15*b*, and 15*c* and the first utilization pipes 57*a*, 57*b*, and 57*c* is sent to the utilization-side heat exchangers 52*a*, 52*b*, and 52*c*.

Then, the high-pressure refrigerant sent to the utilization-side heat exchangers 52*a*, 52*b*, and 52*c* exchanges heat with indoor air supplied by the indoor fans 53*a*, 53*b*, and 53*c* in the utilization-side heat exchangers 52*a*, 52*b*, and 52*c*. As a result, the refrigerant flowing through the utilization-side heat exchangers 52*a*, 52*b*, and 52*c* dissipates heat. The indoor air is heated and is supplied into the room. As a result, an indoor space is heated. The refrigerant having dissipated heat in the utilization-side heat exchangers 52*a*, 52*b*, and 52*c* flows through the second utilization pipes 56*a*, 56*b*, and 56*c*, and passes through the utilization-side expansion valves 51*a*, 51*b*, and 51*c* whose opening degrees are adjusted. Thereafter, the refrigerant having flowed through the second connection pipes 16*a*, 16*b*, and 16*c* flows through the third branch pipes 61*a*, 61*b*, and 61*c* of the branch units 6*a*, 6*b*, and 6*c*, respectively.

Then, the refrigerant sent to the third branch pipes 61*a*, 61*b*, and 61*c* is sent to the secondary-side third connection pipe 7 and joins.

Then, the refrigerant sent to the secondary-side third connection pipe 7 is sent to the heat source-side expansion valve 36 through the third shutoff valve 31. A flow rate of the refrigerant sent to the heat source-side expansion valve 36 is adjusted by the heat source-side expansion valve 36 and then sent to the cascade heat exchanger 35. In the cascade heat exchanger 35, the secondary-side refrigerant flowing through the secondary-side flow path 35*a* evaporates to become a low-pressure gas refrigerant and is sent to the secondary-side switching mechanism 22. The primary-side refrigerant flowing through the primary-side flow path 35*b* of the cascade heat exchanger 35 condenses. Then, the secondary-side low-pressure gas refrigerant sent to the first switching valve 22*a* of the secondary-side switching mechanism 22 is returned to the suction side of the secondary-side compressor 21 through the suction flow path 23 and the secondary-side accumulator 30.

Note that, in this heating operation, the secondary-side refrigerant circuit 10 controls capacity, for example, by controlling the secondary-side compressor 21 so as to process loads in the utilization-side heat exchanger 52*a*, 52*b*, and 52*c*. The primary-side refrigerant circuit 5*a* controls capacity, for example, by controlling the primary-side compressor 71 such that condensation temperature of the primary-side refrigerant in the primary-side flow path 35*b* of the cascade heat exchanger 35 becomes predetermined primary-side condensation target temperature.

In this manner, the operation in the heating operation is performed.

(9-3) Cooling Main Operation

Figure 5:
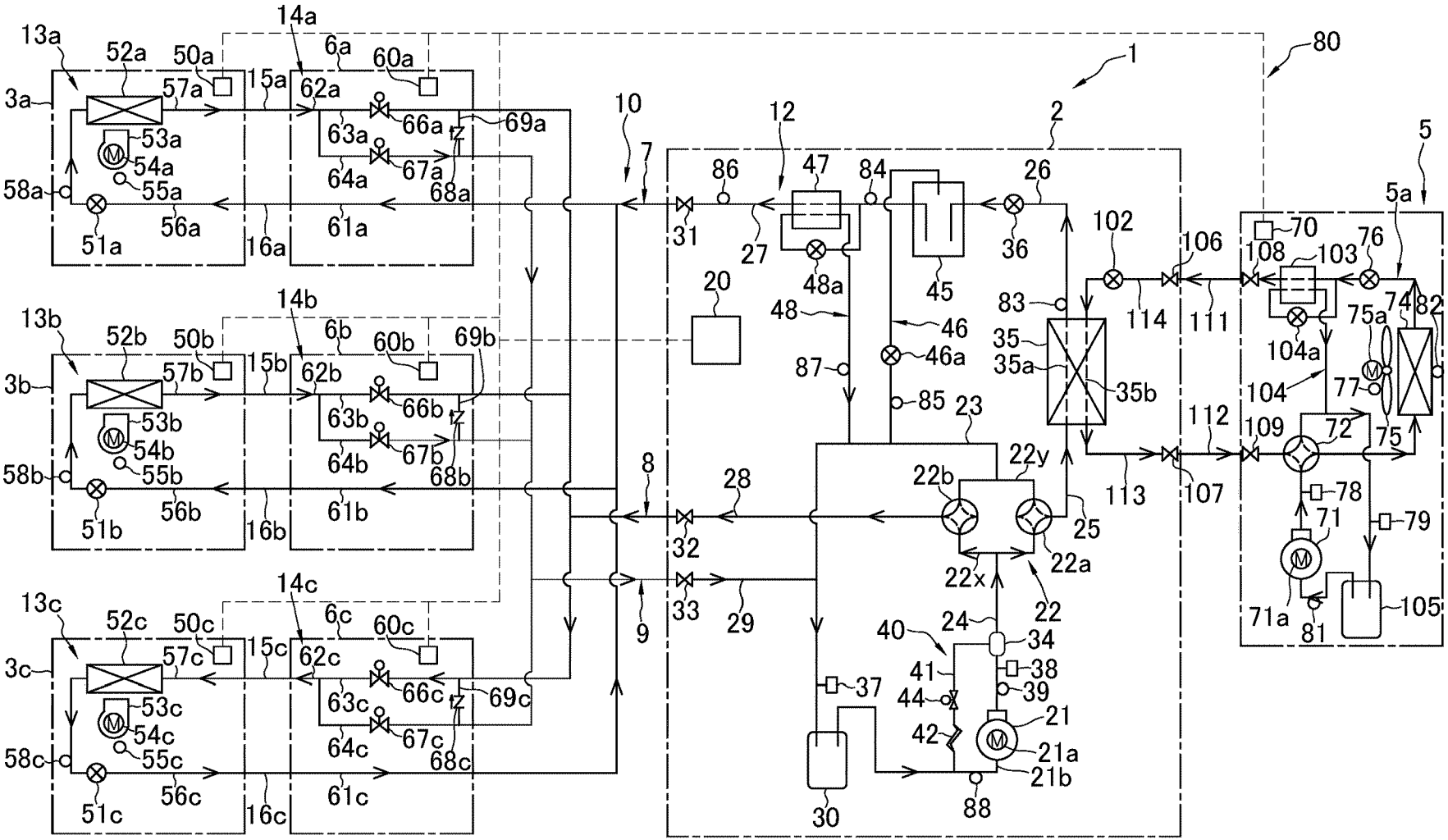
FIG. 5 is a diagram illustrating an operation (a flow of a refrigerant) in simultaneous cooling and heating operation (cooling main operation) of the refrigeration cycle apparatus.

In the cooling main operation, for example, the utilization-side heat exchangers 52*a* and 52*b* of the utilization units 3*a* and 3*b* function as refrigerant evaporators, and the utilization-side heat exchanger 52*c* of the utilization unit 3*c* functions as a refrigerant radiator. In the cooling main operation, the cascade heat exchanger 35 functions as a radiator for the secondary-side refrigerant. In the cooling main operation, the primary-side refrigerant circuit 5*a* and the secondary-side refrigerant circuit 10 of the refrigeration cycle apparatus 1 are configured as illustrated in FIG. 5. Arrows attached to the primary-side refrigerant circuit 5*a* and arrows attached to the secondary-side refrigerant circuit 10 in FIG. 5 indicate flows of the refrigerant during the cooling main operation.

Specifically, in the primary-side unit 5, the primary-side switching mechanism 72 is switched to the fifth connection state (state indicated by solid lines in the primary-side switching mechanism 72 in FIG. 5), so that the cascade heat exchanger 35 functions as an evaporator for the primary-side refrigerant. As a result, in the primary-side unit 5, the primary-side refrigerant discharged from the primary-side compressor 71 passes through the primary-side switching mechanism 72, and is condensed by exchanging heat with outdoor air supplied from the primary-side fan 75 in the primary-side heat exchanger 74. The primary-side refrigerant condensed in the primary-side heat exchanger 74 passes through the primary-side first expansion valve 76 controlled to a fully open state. A part of the refrigerant flows toward the first liquid shutoff valve 108 through the primary-side subcooling heat exchanger 103, and another part of the refrigerant branches and flows into the primary-side subcooling circuit 104. The refrigerant flowing through the primary-side subcooling circuit 104 is decompressed when passing through the primary-side subcooling expansion valve 104*a*. The refrigerant flowing from the primary-side first expansion valve 76 toward the first liquid shutoff valve 108 exchanges heat with the refrigerant decompressed by the primary-side subcooling expansion valve 104*a* and flowing through the primary-side subcooling circuit 104 in the primary-side subcooling heat exchanger 103, and is cooled until reaching a subcooled state. The refrigerant in the subcooled state flows through the primary-side first connection pipe 111, the second liquid shutoff valve 106, and the second refrigerant pipe 114 in this order, and is decompressed by the primary-side second expansion valve 102. At this time, for example, a valve opening degree of the primary-side second expansion valve 102 is controlled such that a degree of superheating of the refrigerant sucked into the primary-side compressor 71 satisfies a predetermined condition. When flowing through the primary-side flow path 35*b* of the cascade heat exchanger 35, the primary-side refrigerant decompressed by the primary-side second expansion valve 102 evaporates by exchanging heat with the secondary-side refrigerant flowing through the secondary-side flow path 35*a*, and flows toward the second gas shutoff valve 107 through the first refrigerant pipe 113. The refrigerant having passed through the second gas shutoff valve 107 passes through the primary-side second connection pipe 112 and the first gas shutoff valve 109, and then reaches the primary-side switching mechanism 72. The refrigerant that has passed through the primary-side switching mechanism 72 joins the refrigerant that has flowed through the primary-side subcooling circuit 104, and is then sucked into the primary-side compressor 71 via the primary-side accumulator 105.

Further, in the heat source unit 2, the secondary-side switching mechanism 22 is switched to the third connection state in which the discharge flow path 24 and the third heat source pipe 25 are connected by the first switching valve 22*a* and the discharge flow path 24 and the first heat source pipe 28 are connected by the second switching valve 22*b*, thereby causing the cascade heat exchanger 35 to function as a radiator for the secondary-side refrigerant. Further, an opening degree of the heat source-side expansion valve 36 is adjusted. In the first to third branch units 6*a*, 6*b*, and 6*c*, the first control valve 66*c* and the second control valves 67*a* and 67*b* are controlled to open states, and the first control valves 66*a* and 66*b* and the second control valve 67*c* are controlled to closed states. Accordingly, the utilization-side heat exchangers 52*a* and 52*b* of the utilization units 3*a* and 3*b* function as refrigerant evaporators, and the utilization-side heat exchanger 52*c* of the utilization unit 3*c* functions as a refrigerant radiator. Further, the utilization-side heat exchangers 52*a* and 52*b* of the utilization units 3*a* and 3*b* and the suction side of the secondary-side compressor 21 of the heat source unit 2 are connected via the secondary-side second connection pipe 9, and the utilization-side heat exchanger 52*c* of the utilization unit 3*c* and the discharge side of the secondary-side compressor 21 of the heat source unit 2 are connected via the secondary-side first connection pipe 8. In addition, an opening degree of the secondary-side subcooling expansion valve 48*a* is controlled such that a degree of subcooling of the secondary-side refrigerant flowing through the outlet of the secondary-side subcooling heat exchanger 47 toward the secondary-side third connection pipe 7 satisfies a predetermined condition. The bypass expansion valve 46*a* is controlled to a closed state. In the utilization units 3*a*, 3*b*, and 3*c*, opening degrees of the utilization-side expansion valves 51*a*, 51*b*, and 51*c* are adjusted.

In such a secondary-side refrigerant circuit 10, a part of the secondary-side high-pressure refrigerant compressed and discharged by the secondary-side compressor 21 is sent to the secondary-side first connection pipe 8 through the second switching valve 22*b* of the secondary-side switching mechanism 22, the first heat source pipe 28, and the first shutoff valve 32, and the rest is sent to the secondary-side flow path 35*a* of the cascade heat exchanger 35 through the first switching valve 22*a* of the secondary-side switching mechanism 22 and the third heat source pipe 25.

Then, the high-pressure refrigerant sent to the secondary-side first connection pipe 8 is sent to the first branch pipe 63*c*. The high-pressure refrigerant sent to the first branch pipe 63*c* is sent to the utilization-side heat exchanger 52*c* of the utilization unit 3*c* via the first control valve 66*c* and the junction pipe 62*c*.

Then, the high-pressure refrigerant sent to the utilization-side heat exchanger 52*c* exchanges heat with indoor air supplied by the indoor fan 53*c* in the utilization-side heat exchanger 52*c*. As a result, the refrigerant flowing through the utilization-side heat exchanger 52*c* dissipates heat. The indoor air is heated and supplied into the room, and the heating operation of the utilization unit 3*c* is performed. The refrigerant having dissipated heat in the utilization-side heat exchanger 52*c* flows through the second utilization pipe 56*c*, and a flow rate of the refrigerant is adjusted in the utilization-side expansion valve 51*c*. Thereafter, the refrigerant flowing through the second connection pipe 16*c* is sent to the third branch pipe 61*c* of the branch unit 6*c*.

Then, the refrigerant sent to the third branch pipe 61*c* is sent to the secondary-side third connection pipe 7.

Further, the high-pressure refrigerant sent to the secondary-side flow path 35*a* of the cascade heat exchanger 35 radiates heat by exchanging heat with the primary-side refrigerant flowing through the primary-side flow path 35*b* in the cascade heat exchanger 35. The secondary-side refrigerant that has dissipated heat in the cascade heat exchanger 35 flows into the secondary-side receiver 45 after a flow rate of the refrigerant is adjusted in the heat source-side expansion valve 36. A part of the refrigerant that has flowed out of the secondary-side receiver 45 branches and flows into the secondary-side subcooling circuit 48, is decompressed by the secondary-side subcooling expansion valve 48*a*, and then joins the suction flow path 23. In the secondary-side subcooling heat exchanger 47, another part of the refrigerant that has flowed out of the secondary-side receiver 45 is cooled by the refrigerant flowing through the secondary-side subcooling circuit 48, and then is sent to the secondary-side third connection pipe 7 through the third shutoff valve 31 to join the refrigerant having radiated heat in the utilization-side heat exchanger 52*c*.

Then, the refrigerant joined at the secondary-side third connection pipe 7 branches into two and is sent to the third branch pipes 61*a* and 61*b* of the branch units 6*a* and 6*b*. Thereafter, the refrigerant having flowed through the second connection pipes 16*a* and 16*b* is sent to the second utilization pipes 56*a* and 56*b* of the first and second utilization units 3*a* and 3*b*. The refrigerant flowing through the second utilization pipes 56*a* and 56*b* passes through the utilization-side expansion valves 51*a* and 51*b* of the utilization units 3*a* and 3*b*.

Then, the refrigerant having passed through the utilization-side expansion valves 51*a* and 51*b* whose opening degrees are adjusted exchanges heat with indoor air supplied by the indoor fans 53*a* and 53*b* in the utilization-side heat exchangers 52*a* and 52*b*. As a result, the refrigerant flowing through the utilization-side heat exchangers 52*a* and 52*b* evaporates and becomes a low-pressure gas refrigerant. The indoor air is cooled and is supplied into the room. As a result, an indoor space is cooled. The low-pressure gas refrigerant evaporated in the utilization-side heat exchangers 52*a* and 52*b* is sent to the junction pipes 62*a* and 62*b* of the first and second branch units 6*a* and 6*b*.

Then, the low-pressure gas refrigerant sent to the junction pipes 62*a* and 62*b* is sent to the secondary-side second connection pipe 9 through the second control valves 67*a* and 67*b* and the second branch pipes 64*a* and 64*b* to join.

Then, the low-pressure gas refrigerant sent to the secondary-side second connection pipe 9 is returned to the suction side of the secondary-side compressor 21 through the second shutoff valve 33, the second heat source pipe 29, the suction flow path 23, and the secondary-side accumulator 30.

Note that, in this cooling main operation, the secondary-side refrigerant circuit 10 controls capacity, for example, by controlling the secondary-side compressor 21 such that evaporation temperature in a heat exchanger functioning as an evaporator for the secondary-side refrigerant among the utilization-side heat exchanger 52*a*, 52*b*, and 52*c* becomes predetermined secondary-side evaporation target temperature. The primary-side refrigerant circuit 5*a* controls capacity, for example, by controlling the primary-side compressor 71 such that evaporation temperature of the primary-side refrigerant in the primary-side flow path 35*b* of the cascade heat exchanger 35 becomes predetermined primary-side evaporation target temperature. Here, the primary-side evaporation target temperature is changed such that a carbon dioxide refrigerant flowing through the secondary-side flow path 35*a* of the cascade heat exchanger 35 does not exceed a critical point when an operation condition is not a predetermined operation condition in which the carbon dioxide refrigerant exceeds the critical point. Also, the primary-side evaporation target temperature is changed such that the carbon dioxide refrigerant exceeds the critical point by more than a predetermined amount when the operation condition is the predetermined operation condition in which the carbon dioxide refrigerant exceeds the critical point.

In this manner, the operation in the cooling main operation is performed.

(9-4) Heating Main Operation

Figure 6:
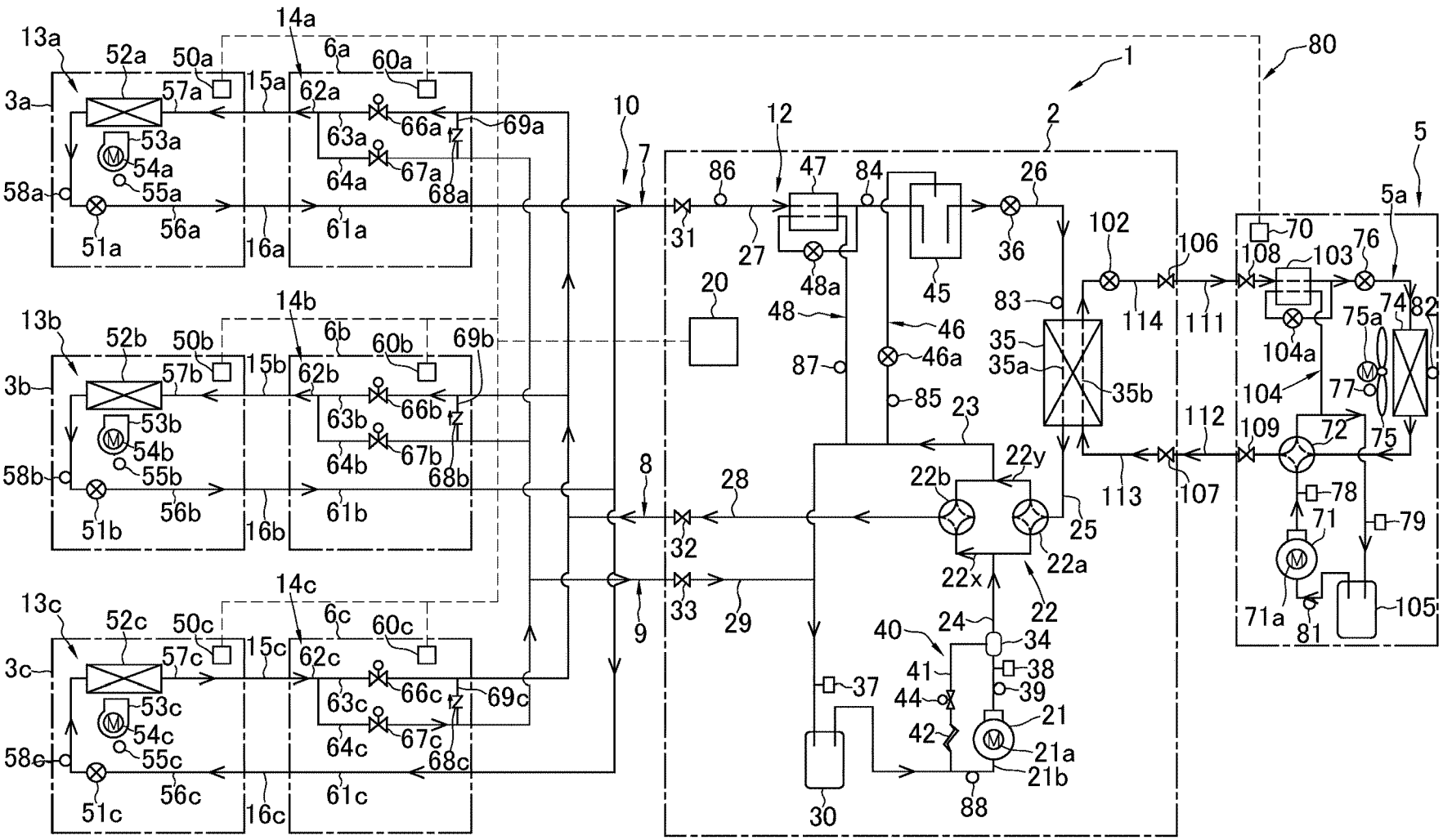
FIG. 6 is a diagram illustrating an operation (a flow of a refrigerant) in simultaneous cooling and heating operation (heating main operation) of the refrigeration cycle apparatus.

In the heating main operation, for example, the utilization-side heat exchangers 52*a* and 52*b* of the utilization units 3*a* and 3*b* function as refrigerant radiators, and the utilization-side heat exchanger 52*c* functions as a refrigerant evaporator. In the heating main operation, the cascade heat exchanger 35 functions as an evaporator for the secondary-side refrigerant. In the heating main operation, the primary-side refrigerant circuit 5*a* and the secondary-side refrigerant circuit 10 of the refrigeration cycle apparatus 1 are configured as illustrated in FIG. 6. Arrows attached to the primary-side refrigerant circuit 5*a* and arrows attached to the secondary-side refrigerant circuit 10 in FIG. 6 indicate flows of the refrigerant during the heating main operation.

Specifically, in the primary-side unit 5, by switching the primary-side switching mechanism 72 to the sixth connection state, the cascade heat exchanger 35 functions as a radiator for the primary-side refrigerant. The sixth connection state of the primary-side switching mechanism 72 is a connection state indicated by broken lines in the primary-side switching mechanism 72 in FIG. 6. As a result, in the primary-side unit 5, the primary-side refrigerant discharged from the primary-side compressor 71, passed through the primary-side switching mechanism 72, and passed through the first gas shutoff valve 109 passes through the primary-side second connection pipe 112 and the second gas shutoff valve 107, and is sent to the primary-side flow path 35*b* of the cascade heat exchanger 35. The refrigerant flowing through the primary-side flow path 35*b* of the cascade heat exchanger 35 is condensed by exchanging heat with the secondary-side refrigerant flowing through the secondary-side flow path 35*a*. When flowing through the second refrigerant pipe 114, the primary-side refrigerant condensed in the cascade heat exchanger 35 passes through the primary-side second expansion valve 102 controlled to a fully open state. Then, the primary-side refrigerant flows through the second liquid shutoff valve 106, the primary-side first connection pipe 111, the first liquid shutoff valve 108, and the primary-side subcooling heat exchanger 103 in this order, and is decompressed by the primary-side first expansion valve 76. Note that, during the heating main operation, the primary-side subcooling expansion valve 104*a* is controlled to a closed state, so that the refrigerant does not flow into the primary-side subcooling circuit 104. Therefore, heat is not exchanged in the primary-side subcooling heat exchanger 103 either. Note that a valve opening degree of the primary-side first expansion valve 76 is controlled such that, for example, a degree of superheating of the refrigerant sucked into the primary-side compressor 71 satisfies a predetermined condition. The refrigerant decompressed by the primary-side first expansion valve 76 evaporates by exchanging heat with outdoor air supplied from the primary-side fan 75 in the primary-side heat exchanger 74, passes through the primary-side switching mechanism 72 and the primary-side accumulator 105, and is sucked into the primary-side compressor 71.

In the heat source unit 2, the secondary-side switching mechanism 22 is switched to the second connection state. In the second connection state of the secondary-side switching mechanism 22, the discharge flow path 24 and the first heat source pipe 28 are connected by the second switching valve 22*b*, and the third heat source pipe 25 and the suction flow path 23 are connected by the first switching valve 22*a*. The cascade heat exchanger 35 thus functions as an evaporator for the second-side refrigerant. Further, an opening degree of the heat source-side expansion valve 36 is adjusted. In the first to third branch units 6*a*, 6*b*, and 6*c*, the first control valves 66*a* and 66*b* and the second control valve 67*c* are controlled to open states, and the first control valve 66*c* and the second control valves 67*a* and 67*b* are controlled to closed states. Accordingly, the utilization-side heat exchangers 52*a* and 52*b* of the utilization units 3*a* and 3*b* function as refrigerant radiators, and the utilization-side heat exchanger 52*c* of the utilization unit 3*c* functions as a refrigerant evaporator. The utilization-side heat exchanger 52*c* of the utilization unit 3*c* and the suction side of the secondary-side compressor 21 of the heat source unit 2 are connected via the first utilization pipe 57*c*, the first connection pipe 15*c*, the junction pipe 62*c*, the second branch pipe 64*c*, and the secondary-side second connection pipe 9. Further, the utilization-side heat exchangers 52*a* and 52*b* of the utilization units 3*a* and 3*b* and the discharge side of the secondary-side compressor 21 of the heat source unit 2 are connected via the discharge flow path 24, the first heat source pipe 28, the secondary-side first connection pipe 8, the first branch pipes 63*a* and 63*b*, the junction pipes 62*a* and 62*b*, the first connection pipes 15*a* and 15*b*, and the first utilization pipes 57*a* and 57*b*. Further, the secondary-side subcooling expansion valve 48*a* and the bypass expansion valve 46*a* are controlled to closed states. In the utilization units 3*a*, 3*b*, and 3*c*, opening degrees of the utilization-side expansion valves 51*a*, 51*b*, and 51*c* are adjusted.

In such a secondary-side refrigerant circuit 10, the high-pressure secondary-side refrigerant compressed and discharged by the secondary-side compressor 21 is sent to the secondary-side first connection pipe 8 through the second switching valve 22*b* of the secondary-side switching mechanism 22, the first heat source pipe 28, and the first shutoff valve 32.

Then, the high-pressure refrigerant sent to the secondary-side first connection pipe 8 is branched into two and sent to the first branch pipes 63*a* and 63*b* of the first branch unit 6*a* and the second branch unit 6*b* respectively connected to the first utilization unit 3*a* and the second utilization unit 3*b*, which are the utilization units in operation. The high-pressure refrigerant sent to the first branch pipes 63*a* and 63*b* is sent to the utilization-side heat exchangers 52*a* and 52*b* of the first utilization unit 3*a* and the second utilization unit 3*b* through the first control valves 66*a* and 66*b*, the junction pipes 62*a* and 62*b*, and the first connection pipes 15*a* and 15*b*.

Then, the high-pressure refrigerant sent to the utilization-side heat exchangers 52*a* and 52*b* exchange heat with indoor air supplied by the indoor fans 53*a* and 53*b* in the utilization-side heat exchangers 52*a* and 52*b*. As a result, the refrigerant flowing through the utilization-side heat exchangers 52*a* and 52*b* dissipates heat. The indoor air is heated and is supplied into the room. As a result, an indoor space is heated. The refrigerant having dissipated heat in the utilization-side heat exchangers 52*a* and 52*b* flows through the second utilization pipes 56*a* and 56*b* and passes through the utilization-side expansion valves 51*a* and 51*b* whose opening degrees are adjusted. Thereafter, the refrigerant having flowed through the second connection pipes 16*a* and 16*b* is sent to the secondary-side third connection pipe 7 via the third branch pipes 61*a* and 61*b* of the branch units 6*a* and 6*b*.

Then, a part of the refrigerant sent to the secondary-side third connection pipe 7 is sent to the third branch pipe 61*c* of the branch unit 6*c*, and the rest is sent to the heat source-side expansion valve 36 through the third shutoff valve 31.

Then, the refrigerant sent to the third branch pipe 61*c* flows through the second utilization pipe 56*c* of the utilization unit 3*c* via the second connection pipe 16*c*, and is sent to the utilization-side expansion valve 51*c*.

Then, the refrigerant having passed through the utilization-side expansion valve 51*c* whose opening degree is adjusted exchanges heat with indoor air supplied by the indoor fan 53*c* in the utilization-side heat exchanger 52*c*. As a result, the refrigerant flowing through the utilization-side heat exchanger 52*c* evaporates and becomes a low-pressure gas refrigerant. The indoor air is cooled and is supplied into the room. As a result, an indoor space is cooled. The low-pressure gas refrigerant evaporated in the utilization-side heat exchanger 52*c* passes through the first utilization pipe 57*c* and the first connection pipe 15*c*, and is sent to the junction pipe 62*c*.

Then, the low-pressure gas refrigerant sent to the junction pipe 62*c* is sent to the secondary-side second connection pipe 9 through the second control valve 67*c* and the second branch pipe 64*c*.

Then, the low-pressure gas refrigerant sent to the secondary-side second connection pipe 9 is returned to the suction side of the secondary-side compressor 21 through the second shutoff valve 33, the second heat source pipe 29, the suction flow path 23, and the secondary-side accumulator 30.

Further, the refrigerant sent to the heat source-side expansion valve 36 passes through the heat source-side expansion valve 36 whose opening degree is adjusted, and then exchanges heat with the primary-side refrigerant flowing through the primary-side flow path 35*b* in the secondary-side flow path 35*a* of the cascade heat exchanger 35. As a result, the refrigerant flowing through the secondary-side flow path 35*a* of the cascade heat exchanger 35 evaporates to become a low-pressure gas refrigerant, and is sent to the first switching valve 22*a* of the secondary-side switching mechanism 22. The low-pressure gas refrigerant sent to the first switching valve 22*a* of the secondary-side switching mechanism 22 joins the low-pressure gas refrigerant evaporated in the utilization-side heat exchanger 52*c* in the suction flow path 23. The joined refrigerant is returned to the suction side of the secondary-side compressor 21 via the secondary-side accumulator 30.

Note that, in this heating main operation, the secondary-side refrigerant circuit 10 controls capacity, for example, by controlling the secondary-side compressor 21 so as to process a load in a heat exchanger functioning as a radiator for the secondary-side refrigerant among the utilization-side heat exchangers 52*a*, 52*b*, and 52*c*. The primary-side refrigerant circuit 5*a* controls capacity, for example, by controlling the primary-side compressor 71 such that condensation temperature of the primary-side refrigerant in the primary-side flow path 35*b* of the cascade heat exchanger 35 becomes predetermined primary-side condensation target temperature.

In this manner, the operation in the heating main operation is performed.

(10) Structure of Primary-Side Unit and Heat Source Unit

FIG. 7 is a schematic external view illustrating a state in which the primary-side unit 5 and the heat source unit 2 are connected.

The primary-side unit 5 has the primary-side casing 5*x* having a substantially rectangular parallelepiped shape configured to have a plurality of surfaces. The primary-side casing 5*x* accommodates, as a part of the primary-side refrigerant circuit 5*a*, the primary-side compressor 71, the primary-side switching mechanism 72, the primary-side heat exchanger 74, the primary-side first expansion valve 76, the primary-side subcooling heat exchanger 103, the primary-side subcooling circuit 104, the primary-side subcooling expansion valve 104*a*, the first liquid shutoff valve 108, the first gas shutoff valve 109, and the primary-side accumulator 105. The primary-side first connection pipe 111 and the primary-side second connection pipe 112, which are parts of the primary-side refrigerant circuit 5*a*, extend from the primary-side casing 5*x*.

The heat source unit 2 includes the heat source casing 2*x* having a substantially rectangular parallelepiped shape. A part of the secondary-side refrigerant circuit 10 and a part of the primary-side refrigerant circuit 5*a* are accommodated in the heat source casing 2*x*. A part of the secondary-side refrigerant circuit 10 accommodated in the heat source casing 2*x* is the heat source circuit 12 including the secondary-side compressor 21, the secondary-side switching mechanism 22, the first heat source pipe 28, the second heat source pipe 29, the suction flow path 23, the discharge flow path 24, the third heat source pipe 25, the fourth heat source pipe 26, the fifth heat source pipe 27, the secondary-side flow path 35*a* of the cascade heat exchanger 35, the heat source-side expansion valve 36, the third shutoff valve 31, the first shutoff valve 32, the second shutoff valve 33, the secondary-side accumulator 30, the oil separator 34, the oil return circuit 40, the secondary-side receiver 45, the bypass circuit 46, the bypass expansion valve 46*a*, the secondary-side subcooling heat exchanger 47, the secondary-side subcooling circuit 48, and the secondary-side subcooling expansion valve 48*a*. A part of the primary-side refrigerant circuit 5*a* accommodated in the heat source casing 2*x* includes the second liquid shutoff valve 106, the second refrigerant pipe 114, the primary-side second expansion valve 102, the primary-side flow path 35*b* of the cascade heat exchanger 35, the first refrigerant pipe 113, and the second gas shutoff valve 107. The secondary-side third connection pipe 7, the secondary-side first connection pipe 8, and the secondary-side second connection pipe 9, which are parts of the secondary-side refrigerant circuit 10, extend from the heat source casing 2*x*. Further, the primary-side first connection pipe 111 and the primary-side second connection pipe 112, which are parts of the primary-side refrigerant circuit 5*a*, extend from the heat source casing 2*x*.

The heat source casing 2*x* has a plurality of surfaces including a top surface 120*b*, a first side surface 120*a*, a second side surface 120*c*, a bottom surface 120*d*, a third side surface (not illustrated), and a fourth side surface (not illustrated). Among them, an opening 120*x* is provided in the first side surface 120*a*. The primary-side first connection pipe 111 and the primary-side second connection pipe 112 pass through the opening 120*x*. The cascade heat exchanger 35 is placed on the bottom surface 120*d*.

Note that the second liquid shutoff valve 106 to which the primary-side first connection pipe 111 is connected and the second gas shutoff valve 107 to which the primary-side second connection pipe 112 is connected are located inside the opening 120*x* of the heat source casing 2*x*.

(11) Characteristics of Embodiment

In the refrigeration cycle apparatus 1 according to the present embodiment, the secondary-side refrigerant flowing through the secondary-side flow path 35*a* of the cascade heat exchanger 35 used as the heat source of the secondary-side refrigerant circuit 10 does not exchange heat with outdoor air, but exchanges heat with the primary-side refrigerant flowing through the primary-side refrigerant circuit 5*a*. Since temperature of the outdoor air changes naturally, it cannot be controlled. On the other hand, in the primary-side refrigerant circuit 5*a*, the primary-side compressor 71 or the like can control capacity. For this reason, even if the temperature of the outdoor air changes, the capacity is controlled in the primary-side refrigerant circuit 5*a*, so that it is easy to secure an amount of heat exchange required in the secondary-side flow path 35*a* of the cascade heat exchanger 35 of the secondary-side refrigerant circuit 10. As a result, even if the temperature of the outdoor air changes, the amount of heat exchange in the secondary-side flow path 35*a* of the cascade heat exchanger 35 can be controlled so as to cope with load processing required in the secondary-side refrigerant circuit 10.

In particular, in the present embodiment, the carbon dioxide refrigerant is used as the secondary-side refrigerant in the secondary-side refrigerant circuit 10. This carbon dioxide refrigerant can exceed a critical point when used in a refrigeration cycle. On the other hand, in the refrigeration cycle apparatus 1 according to the present embodiment, the carbon dioxide refrigerant flowing through the secondary-side flow path 35*a* of the cascade heat exchanger 35 does not exchange heat with the outdoor air whose temperature cannot be controlled, but exchanges heat with the primary-side refrigerant whose temperature can be controlled flowing through the primary-side refrigerant circuit 5*a*. Therefore, not only the secondary-side compressor 21 or the like in the secondary-side refrigerant circuit 10 is controlled, but also the temperature and the flow rate of the primary-side refrigerant sent to the primary-side flow path 35*b* of the cascade heat exchanger 35 are controlled, whereby the carbon dioxide refrigerant flowing through the secondary-side flow path 35*a* of the cascade heat exchanger 35 can be prevented from exceeding the critical point. Since behavior of the carbon dioxide refrigerant in the vicinity of the critical point becomes unstable, when an operation condition of the refrigeration cycle apparatus 1 is an operation condition in which the carbon dioxide refrigerant in the secondary-side refrigerant circuit 10 is in the vicinity of the critical point, it is possible to stabilize the refrigeration cycle by controlling the secondary-side refrigerant circuit 10 and the primary-side refrigerant circuit 5*a* so that the carbon dioxide refrigerant greatly exceeds the critical point.

Further, in the refrigeration cycle apparatus 1 of the present embodiment, the binary refrigeration cycle is adopted, so that the secondary-side refrigerant circuit 10 can provide sufficient capacity.

Additionally, in the refrigeration cycle apparatus 1 according to the present embodiment, the secondary-side switching mechanism 22 that switches the flow path of the secondary-side refrigerant circuit 10 is provided on the discharge side of the secondary-side compressor 21. During the cooling operation, the flow path is switched such that the secondary-side switching mechanism 22 is brought into the first connection state, whereby the refrigerant discharged from the secondary-side compressor 21 is sent to the secondary-side flow path 35*a* of the cascade heat exchanger 35 via the first switching valve 22*a* of the secondary-side switching mechanism 22. At this time, in the second switching valve 22*b* of the secondary-side switching mechanism 22, the discharge side of the secondary-side compressor 21 is connected to the closed fourth connection port. Therefore, during the cooling operation, the flow of the refrigerant discharged from the secondary-side compressor 21 is stopped at the second switching valve 22*b* of the secondary-side switching mechanism 22, and does not flow to the first heat source pipe 28 and the secondary-side first connection pipe 8. This can suppress accumulation of the secondary-side refrigerant and the refrigerating machine oil in the first heat source pipe 28 and the secondary-side first connection pipe 8 during the cooling operation. In particular, in the present embodiment, the first heat source pipe 28 and the secondary-side first connection pipe 8 are connected to the suction side of the secondary-side compressor 21 during the cooling operation, so that accumulation of the secondary-side refrigerant and the refrigerating machine oil in the first heat source pipe 28 and the secondary-side first connection pipe 8 is sufficiently suppressed.

This can suppress shortage of the secondary-side refrigerant in the secondary-side refrigerant circuit 10 during the cooling operation.

In addition, a filling amount of the secondary-side refrigerant filled in the secondary-side refrigerant circuit 10 can be reduced. In particular, in the present embodiment, carbon dioxide is used as the secondary-side refrigerant to be filled in the secondary-side refrigerant circuit 10. When a refrigeration cycle is performed in a refrigerant circuit using this carbon dioxide refrigerant, the refrigerant circuit is required to be filled with the carbon dioxide refrigerant at high density. Even when the carbon dioxide refrigerant required to be filled at high density is used, the refrigeration cycle apparatus 1 according to the present embodiment can reduce the filling amount. In addition, since the filling amount of the carbon dioxide refrigerant can be reduced, safety is easily secured even if the carbon dioxide refrigerant leaks from the secondary-side refrigerant circuit 10.

In the refrigeration cycle apparatus 1 according to the present embodiment, the primary-side refrigerant used in the primary-side refrigerant circuit 5*a* is different from the secondary-side refrigerant used in the secondary-side refrigerant circuit 10. For this reason, as the refrigerant of the secondary-side refrigerant circuit 10 flowing through the utilization-side heat exchangers 52*a*, 52*b*, and 52*c* provided in the indoor in which a user stays, a refrigerant having lower flammability than the refrigerant used in the primary-side refrigerant circuit 5*a* can be selected.

Furthermore, in the refrigeration cycle apparatus 1 according to the present embodiment described above, the carbon dioxide refrigerant is used as the refrigerant in the secondary-side refrigerant circuit 10. As compared with a case where the refrigerant such as R32 or R410A is used in all of the primary-side refrigerant circuit 5*a* and the secondary-side refrigerant circuit 10, global warming potential (GWP) and ozone depletion potential (ODP) can be kept low. In addition, even if a refrigerant leak occurs on the utilization side, the refrigerant does not contain chlorofluorocarbon, and thus the chlorofluorocarbon does not flow out on the utilization side.

(12) Other Embodiments

(12-1) Another Embodiment A

In the above embodiment, a case where the first control valves 66*a*, 66*b*, and 66*c* are controlled to the closed states and the second control valves 67*a*, 67*b*, and 67*c* are controlled to the open states during the cooling operation has been described as an example.

Figure 8:
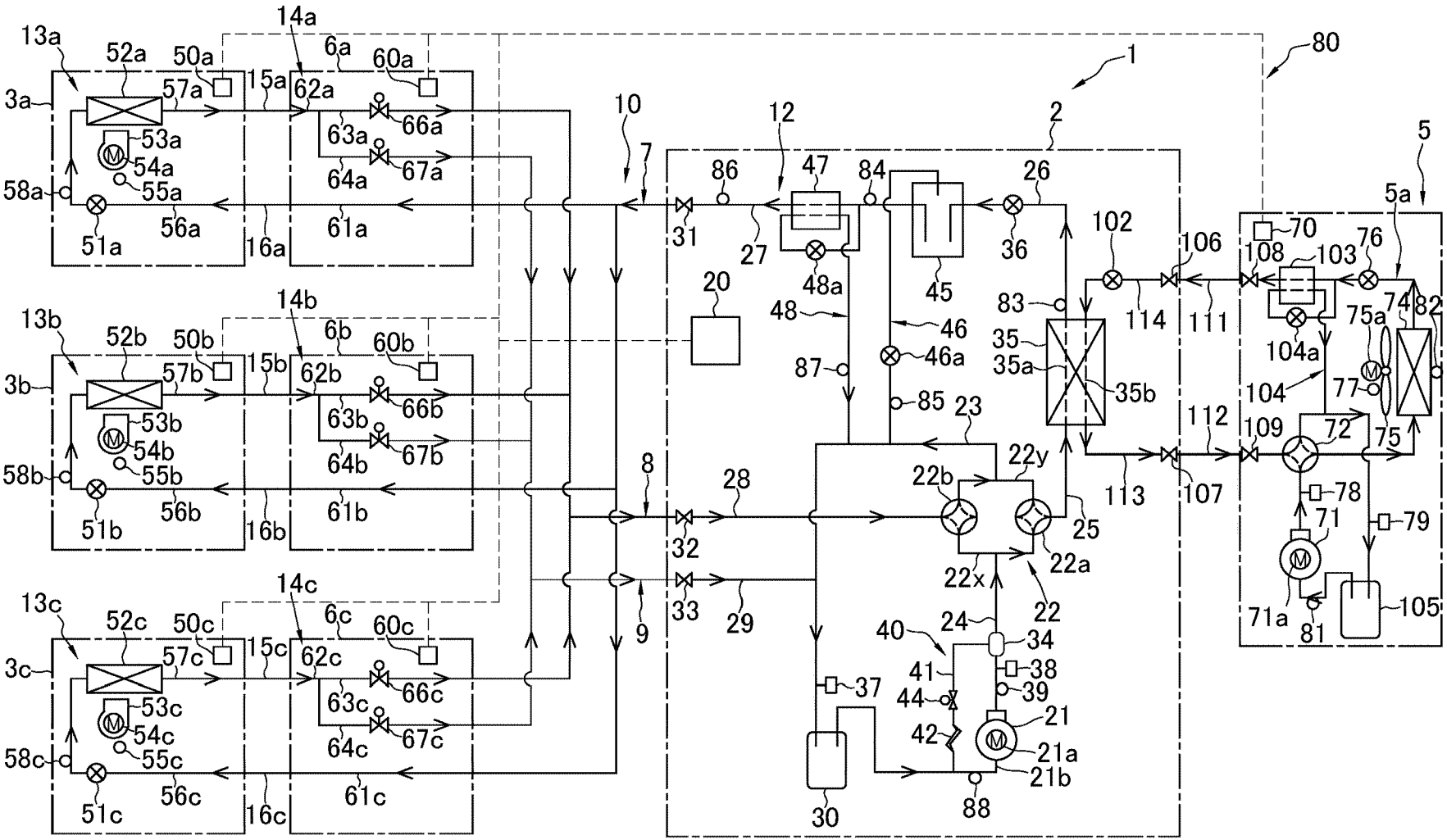
FIG. 8 is a schematic configuration diagram of a refrigeration cycle apparatus according to another embodiment A.

On the other hand, as illustrated in FIG. 8, while the secondary-side refrigerant circuit is a refrigerant circuit in which the bypass pipes 69*a*, 69*b*, and 69*c* provided with the check valves 68*a*, 68*b*, and 68*c* are not provided, both the first control valves 66*a*, 66*b*, and 66*c* and the second control valves 67*a*, 67*b*, and 67*c* may be controlled to open states during the cooling operation. This also allows the secondary-side refrigerant to be returned to the suction side of the secondary-side compressor 21 by using both the flow paths including the second branch pipes 64*a*, 64*b*, and 64*c*, the secondary-side second connection pipe 9, and the second heat source pipe 29, and the flow paths including the first branch pipes 63*a*, 63*b*, and 63*c*, the secondary-side first connection pipe 8, and the first heat source pipe 28. As a result, it is possible to increase a total flow path cross-sectional area when the secondary-side gas state refrigerant evaporated in the utilization-side heat exchangers 52*a*, 52*b*, and 52*c* is sent to the secondary-side compressor 21, so that pressure loss can be reduced.

Note that, when the pressure loss of the secondary-side refrigerant is unlikely to cause a problem, the first control valves 66*a*, 66*b*, and 66*c* may be controlled to closed states during the cooling operation by the above circuit, and the secondary-side refrigerant may be returned to the secondary-side compressor 21 using only the flow paths formed by the second branch pipes 64*a*, 64*b*, and 64*c*, the secondary-side second connection pipe 9, and the second heat source pipe 29.

(12-2) Another Embodiment B

In the above embodiment, a case where the secondary-side switching mechanism 22 includes the first switching valve 22*a* and the second switching valve 22*b*, which are two four-way switching valves, has been described as an example.

Figure 9:
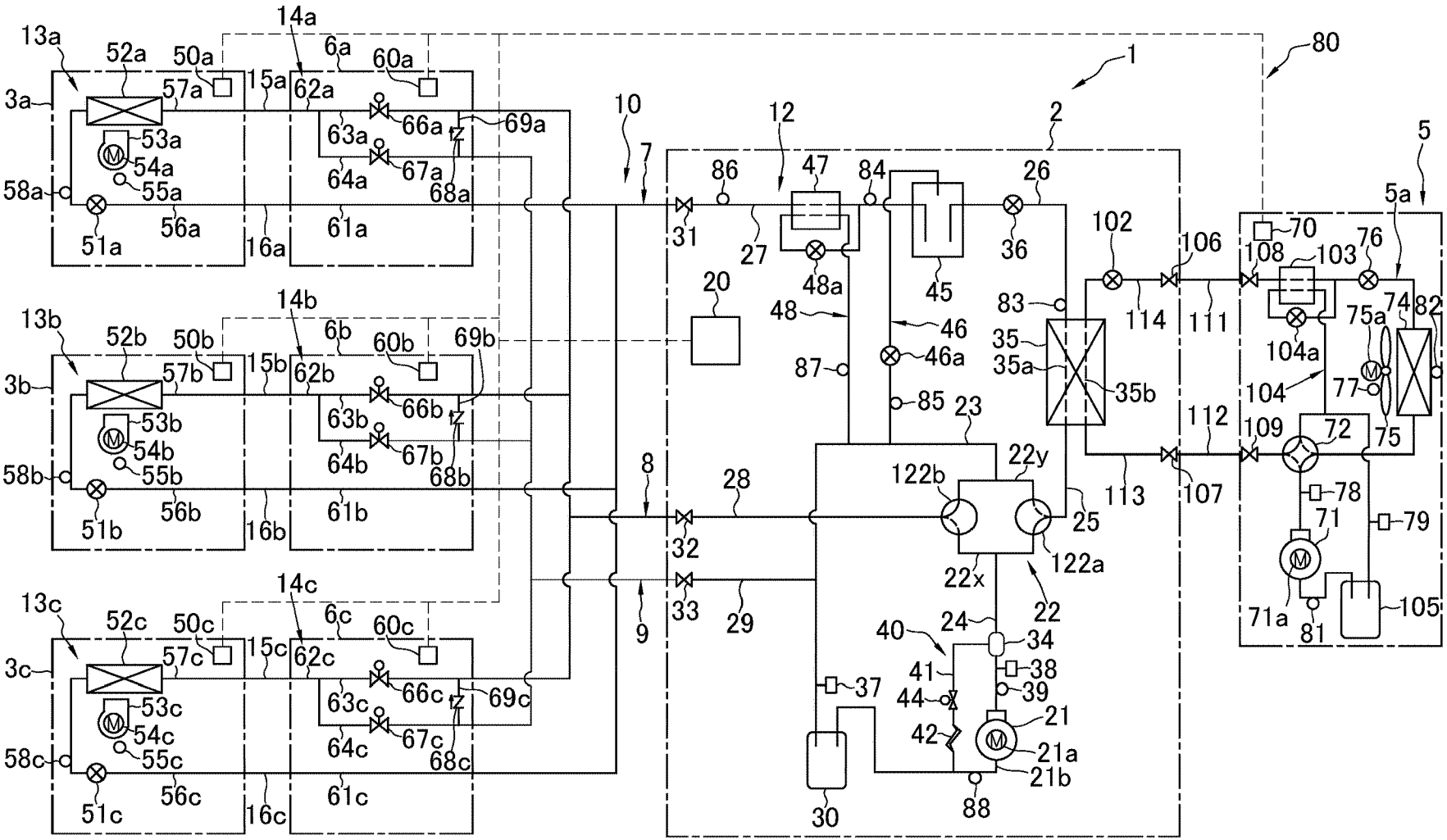
FIG. 9 is a schematic configuration diagram of a refrigeration cycle apparatus according to another embodiment B.

On the other hand, at least one or both of the first switching valve 22*a* and the second switching valve 22*b* of the secondary-side switching mechanism 22 may include a three-way valve having a first connection port, a second connection port, and a third connection port. For example, as illustrated in FIG. 9, the secondary-side switching mechanism 22 may include a first three-way valve 122*a* and a second three-way valve 122*b*. Here, a first connection port, a second connection port, and a third connection port of the first three-way valve 122*a* correspond to the first connection port, the second connection port, and the third connection port of the first switching valve 22*a* of the above embodiment. Further, a first connection port, a second connection port, and a third connection port of the second three-way valve 122*b* correspond to the first connection port, the second connection port, and the third connection port of the second switching valve 22*b* of the above embodiment.

This configuration also produces similar advantageous effects to those of the foregoing embodiment.

(12-3) Another Embodiment C

In the above embodiment, a case where the secondary-side switching mechanism 22 includes the first switching valve 22*a* and the second switching valve 22*b*, which are two four-way switching valves, has been described as an example.

Figure 10:
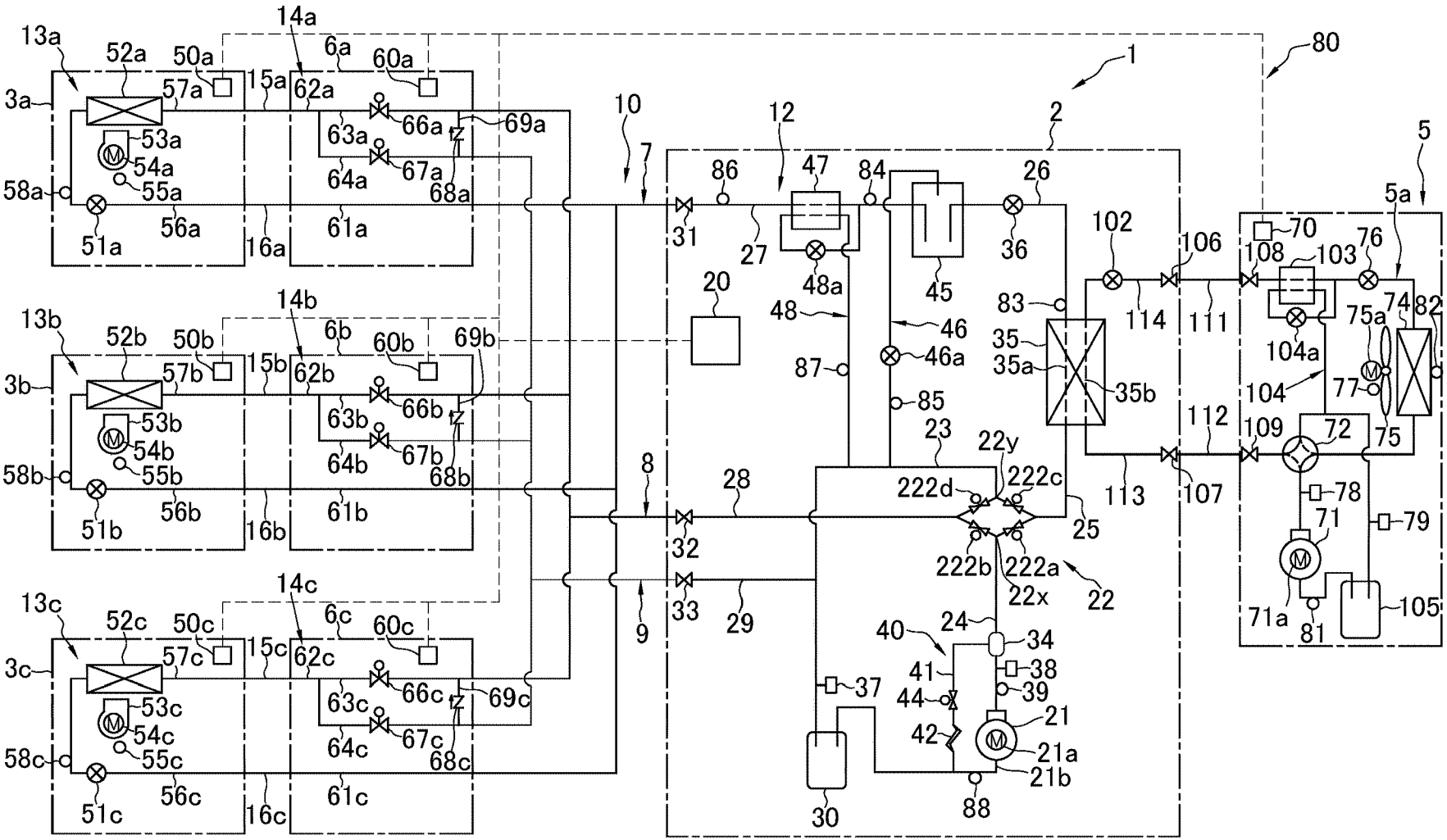
FIG. 10 is a schematic configuration diagram of a refrigeration cycle apparatus according to another embodiment C.

On the other hand, as illustrated in FIG. 10, for example, the secondary-side switching mechanism 22 may be configured by a circular flow path with four on-off valves 222*a*, 222*b*, 222*c*, and 222*d*, which are two-way valves, provided in a row of four.

Specifically, the secondary-side switching mechanism 22 according to another embodiment C includes a first on-off valve 222*a* provided in a flow path connecting the discharge flow path 24 and the third heat source pipe 25, a second on-off valve 222*b* provided in a flow path connecting the discharge flow path 24 and the first heat source pipe 28, a third on-off valve 222*c* provided in a flow path connecting the suction flow path 23 and the third heat source pipe 25, and a fourth on-off valve 222*d* provided in a flow path connecting the suction flow path 23 and the first heat source pipe 28. Each of the first on-off valve 222*a*, the second on-off valve 222*b*, the third on-off valve 222*c*, and the fourth on-off valve 222*d* is an electromagnetic valve that is switched between an open state and a closed state.

When performing the cooling operation for preventing the secondary-side refrigerant discharged from the secondary-side compressor 21 from being sent to the secondary-side first connection pipe 8 while causing the cascade heat exchanger 35 to function as a radiator for the secondary-side refrigerant, the secondary-side switching mechanism 22 according to the other embodiment C is switched to the first connection state by closing the third on-off valve 222*c* while opening the first on-off valve 222*a* to connect the discharge flow path 24 and the third heat source pipe 25, and by opening or closing the fourth on-off valve 222*d* while closing the second on-off valve 222*b*. Further, when the cascade heat exchanger 35 functions as an evaporator for the secondary-side refrigerant to perform the heating operation or the heating main operation, the secondary-side switching mechanism 22 is switched to the second connection state by closing the first on-off valve 222*a* while opening the third on-off valve 222*c* to connect the suction flow path 23 and the third heat source pipe 25, and by closing the fourth on-off valve 222*d* while opening the second on-off valve 222*b* to connect the discharge flow path 24 and the first heat source pipe 28. In addition, when performing the cooling main operation by sending the secondary-side refrigerant discharged from the secondary-side compressor 21 to the secondary-side first connection pipe 8 while causing the cascade heat exchanger 35 to function as a radiator for the secondary-side refrigerant, the secondary-side switching mechanism 22 is switched to the third connection state by closing the third on-off valve 222*c* while opening the first on-off valve 222*a* to connect the discharge flow path 24 and the third heat source pipe 25, and by closing the fourth on-off valve 222*d* while opening the second on-off valve 222*b* to connect the discharge flow path 24 and the first heat source pipe 28.

This configuration also produces similar advantageous effects to those of the foregoing embodiment.

(12-4) Another Embodiment D

In the above embodiment, the secondary-side refrigerant circuit 10 in which the second heat source pipe 29 connected to the secondary-side second connection pipe 9 is connected to the suction flow path 23 has been described as an example.

Figure 11:
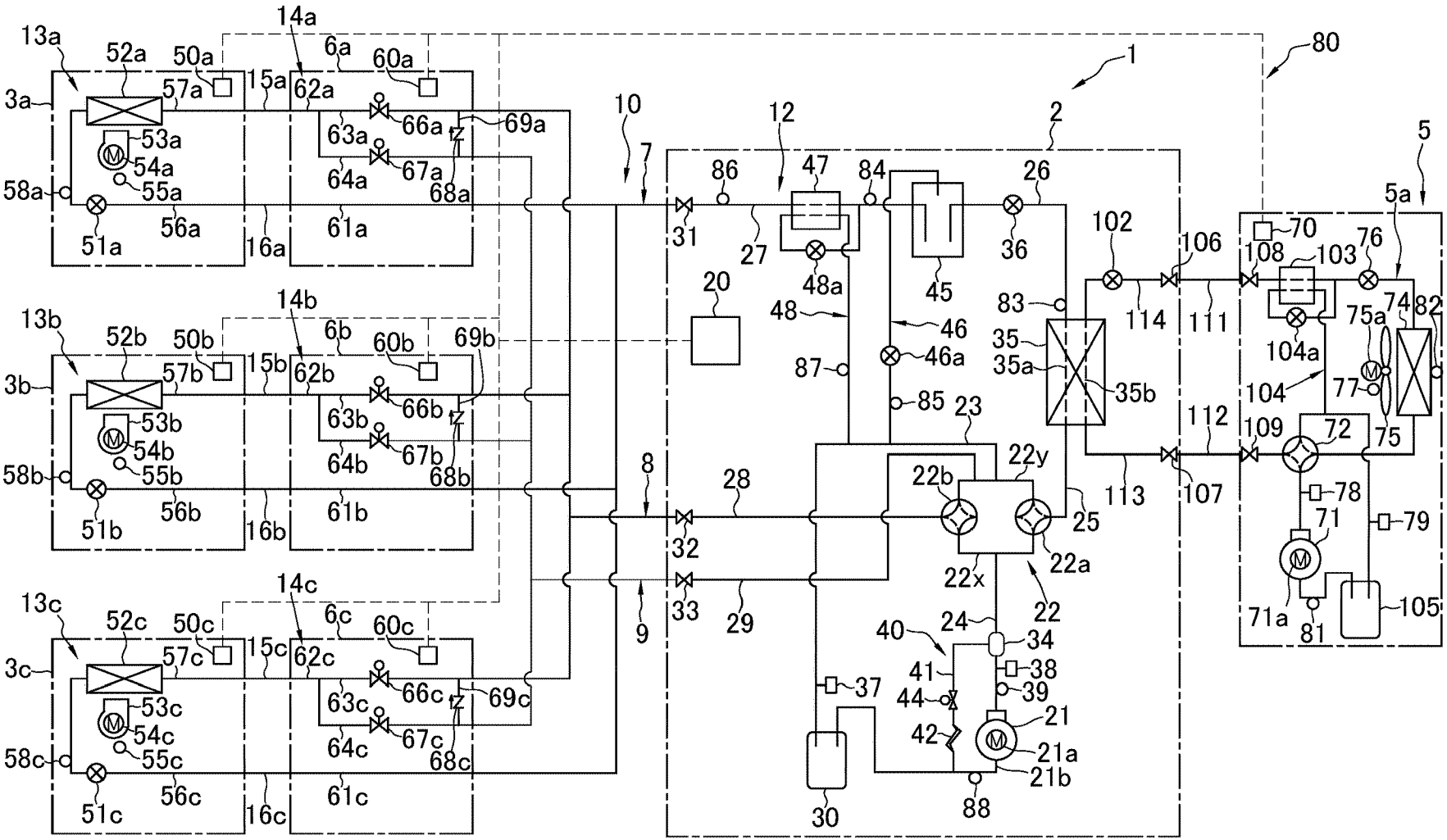
FIG. 11 is a schematic configuration diagram of a refrigeration cycle apparatus according to another embodiment D.

On the other hand, as the secondary-side refrigerant circuit 10, for example, as illustrated in FIG. 11, the second heat source pipe 29 connected to the secondary-side second connection pipe 9 may be connected to a suction-side connection portion 22*y* of the secondary-side switching mechanism 22 instead of the suction flow path 23.

This configuration also produces similar advantageous effects to those of the foregoing embodiment.

(12-5) Another Embodiment E

In the above embodiment, the description has been given by exemplifying the secondary-side refrigerant circuit 10 that includes electromagnetic valves that can only be opened and closed are used as the first control valves 66*a*, 66*b*, and 66*c* and the second control valves 67*a*, 67*b*, and 67*c*, and the bypass pipes 69*a*, 69*b*, and 69*c* provided with the check valves 68*a*, 68*b*, and 68*c* and connecting the first branch pipe 63*a*, 63*b*, and 63*c* and the second branch pipe 64*a*, 64*b*, and 64*c*.

Figure 12:
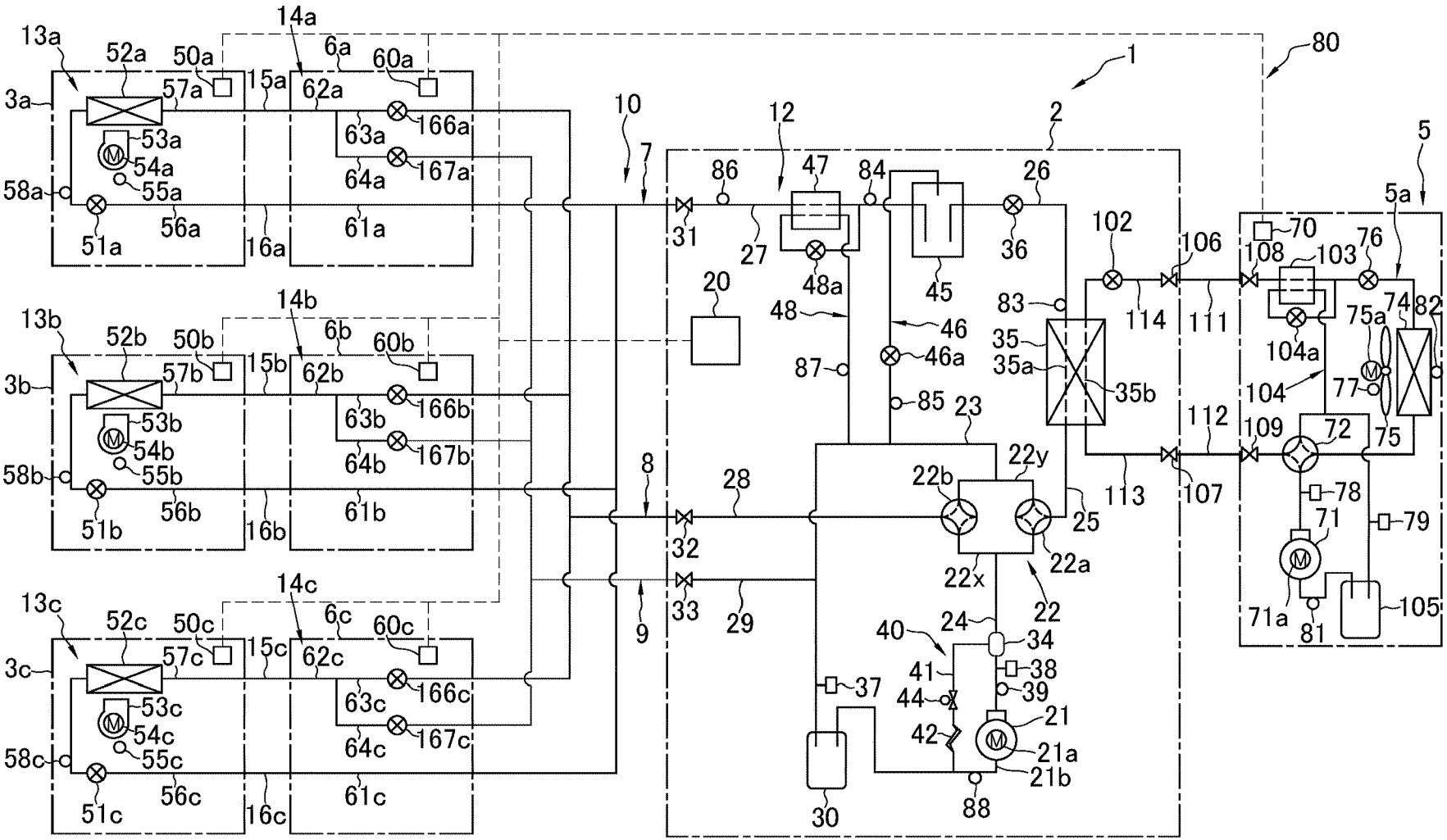
FIG. 12 is a schematic configuration diagram of a refrigeration cycle apparatus according to another embodiment E.

On the other hand, as shown in FIG. 12, as the secondary-side refrigerant circuit 10, instead of the first control valves 66*a*, 66*b*, and 66*c* and the second control valves 67*a*, 67*b*, and 67*c* of the above embodiment, first control valves 166*a*, 166*b*, and 166*c* and second control valves 167*a*, 167*b*, and 167*c* that are electric expansion valves each capable of adjusting an opening degree may be used. Further, in the secondary-side refrigerant circuit 10, the bypass pipes 69*a*, 69*b*, and 69*c* provided with the check valves 68*a*, 68*b*, and 68*c* may be omitted.

This configuration also produces similar advantageous effects to those of the foregoing embodiment.

Note that, in the circuit in which the bypass pipes 69*a*, 69*b*, and 69*c* are omitted, during the cooling operation, both the first control valves 166*a*, 166*b*, and 166*c* and the second control valves 167*a*, 167*b*, and 167*c* may be controlled to open states. Alternatively, the first control valves 166*a*, 166*b*, and 166*c* may be controlled to closed states, and the second control valves 167*a*, 167*b*, and 167*c* may be controlled to open states.

(12-6) Another Embodiment F

In the above embodiment, R32 or R410A is exemplified as the refrigerant used in the primary-side refrigerant circuit 5*a*, and carbon dioxide is exemplified as the refrigerant used in the secondary-side refrigerant circuit 10.

On the other hand, the refrigerant used in the primary-side refrigerant circuit 5*a* is not limited, and an HFC-32, an HFO refrigerant, a mixed refrigerant of the HFC-32 and the HFO refrigerant, carbon dioxide, ammonia, propane, or the like can be used.

Further, the refrigerant used in the secondary-side refrigerant circuit 10 is not limited, and an HFC-32, an HFO refrigerant, a mixed refrigerant of the HFC-32 and the HFO refrigerant, carbon dioxide, ammonia, propane, or the like can be used.

Note that, as the HFO refrigerant, for example, HFO-1234yf, HFO-1234ze, or the like can be used.

Further, the same refrigerant or different refrigerants may be used in the primary-side refrigerant circuit 5*a* and the secondary-side refrigerant circuit 10. Preferably, the refrigerant used in the secondary-side refrigerant circuit 10 has at least one of lower global warming potential (GWP), lower ozone depletion potential (ODP), lower flammability, and lower toxicity than the refrigerant used in the primary-side refrigerant circuit 5*a*. In particular, when an overall content volume of the secondary-side refrigerant circuit 10 is larger than an overall content volume of the primary-side refrigerant circuit 5*a*, by using the refrigerant lower than the refrigerant in the primary-side refrigerant circuit 5*a* in at least one of the global warming potential (GWP), the ozone depletion potential (ODP), the flammability, and the toxicity in the secondary-side refrigerant circuit 10, adverse effects when a leak occurs can be reduced.

(12-7) Another Embodiment G

In the above embodiment, the refrigeration cycle apparatus 1 in which one heat source unit 2 is connected to one primary-side unit 5 has been described as an example.

Figure 13:
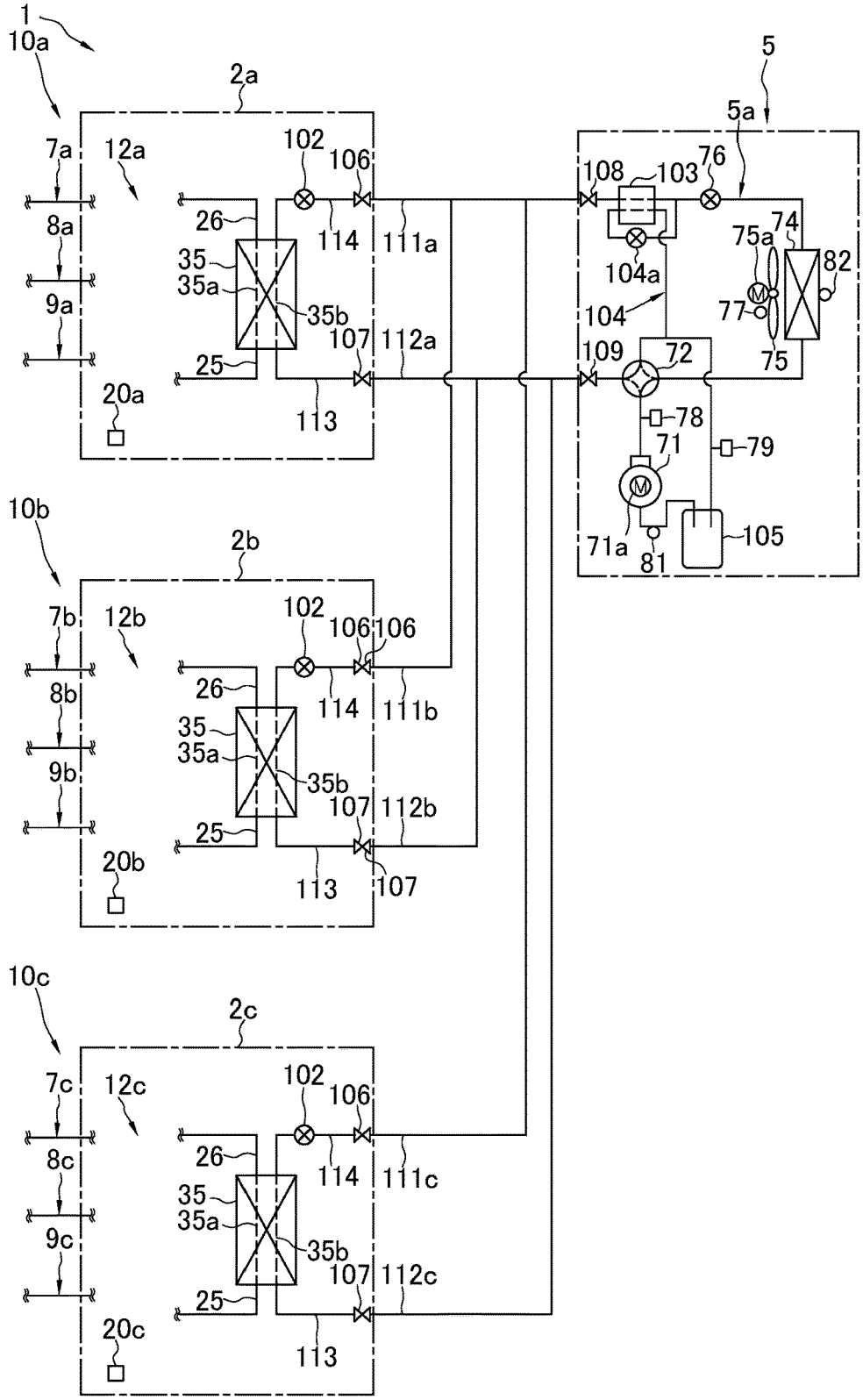
FIG. 13 is a schematic configuration diagram of a refrigeration cycle apparatus according to another embodiment G.

On the other hand, as shown in FIG. 13, for example, by connecting a first heat source unit 2*a*, a second heat source unit 2*b*, and a third heat source unit 2*c*, which are a plurality of heat source units, in parallel to one primary-side unit 5, the refrigeration cycle apparatus 1 may include a first secondary-side refrigerant circuit 10*a* including a first heat source circuit 12*a*, a second secondary-side refrigerant circuit 10*b* including a second heat source circuit 12*b*, and a third secondary-side refrigerant circuit 10*c* including a third heat source circuit 12*c*. Note that, in FIG. 13, an internal structure of each of the first heat source unit 2*a*, the second heat source unit 2*b*, and the third heat source unit 2*c* is similar to that of the heat source unit 2 according to the above embodiment, and thus only a part of each heat source unit is illustrated.

Although not illustrated, each of the first heat source unit 2*a*, the second heat source unit 2*b*, and the third heat source unit 2*c* is connected with the plurality of branch units 6*a*, 6*b*, and 6*c* and the plurality of utilization units 3*a*, 3*b*, and 3*c* as in the above embodiment. Specifically, the first heat source unit 2*a* is connected with a plurality of branch units and utilization units via a secondary-side third connection pipe 7*a*, a secondary-side first connection pipe 8*a*, and a secondary-side second connection pipe 9*a*. The second heat source unit 2*b* is connected, via a secondary-side third connection pipe 7*b*, a secondary-side first connection pipe 8*b*, and a secondary-side second connection pipe 9*b*, with a plurality of branch units and utilization units different from those connected with the first heat source unit 2*a*. The third heat source unit 2*c* is connected, via a secondary-side third connection pipe 7*c*, a secondary-side first connection pipe 8*c*, and a secondary-side second connection pipe 9*c*, with another plurality of branch units and utilization units different from those connected to the first heat source unit 2*a* and different from those connected to the second heat source unit 2*b*.

Here, the primary-side unit 5 and the first heat source unit 2*a* are connected via a primary-side first connection pipe 111*a* via a primary-side second connection pipe 112*a*. The primary-side unit 5 and the second heat source unit 2*b* are connected via a primary-side first connection pipe 111*b* branched from the primary-side first connection pipe 111*a* and a primary-side second connection pipe 112*b* branched from the primary-side second connection pipe 112*a*. The primary-side unit 5 and the third heat source unit 2*c* are connected via a primary-side first connection pipe 111*c* branched from the primary-side first connection pipe 111*a* and a primary-side second connection pipe 112*c* branched from the primary-side second connection pipe 112*a*.

Here, each of the first heat source unit 2*a*, the second heat source unit 2*b*, and the third heat source unit 2*c* includes a primary-side second expansion valve 102 whose opening degree is controlled by the first heat source unit 2*a*, the second heat source unit 2*b*, and the third heat source unit 2*c*. Further, a first heat source-side control unit 20*a* included in the first heat source unit 2*a*, a second heat source-side control unit 20*b* included in the second heat source unit 2*b*, and a third heat source-side control unit 20*c* included in the third heat source unit 2*c* control the opening degree of the corresponding primary-side second expansion valve 102. Similarly to the above embodiment, each of the first heat source-side control unit 20*a*, the second heat source-side control unit 20*b*, and the third heat source-side control unit 20*c* controls the valve opening degree of the corresponding primary-side second expansion valve 102 on the basis of conditions of the first heat source circuit 12*a*, the second heat source circuit 12*b*, and the third heat source circuit 12*c* controlled by the first heat source-side control unit 20*a*, the second heat source-side control unit 20*b*, and the third heat source-side control unit 20*c*. As a result, the primary-side refrigerant flowing through the primary-side refrigerant circuit 5*a* is controlled to have a flow rate of the primary-side refrigerant in the primary-side first connection pipe 111*a* and the primary-side second connection pipe 112*a*, a flow rate of the primary-side refrigerant in the primary-side first connection pipe 111*b* and the primary-side second connection pipe 112*b*, and a flow rate of the primary-side refrigerant in the primary-side first connection pipe 111*c* and the primary-side second connection pipe 112*c* so as to correspond to a difference in loads in the first secondary-side refrigerant circuit 10*a*, the second secondary-side refrigerant circuit 10*b*, and the third secondary-side refrigerant circuit 10*c*.

(12-8) Others

Note that, in the first operation, all of the plurality of second heat exchangers may function as evaporators for the second refrigerant. Alternatively, the second heat exchanger functioning as an evaporator for the second refrigerant and the second heat exchanger in an operation stop state or a state in which the second refrigerant does not flow may coexist in the plurality of second heat exchangers.

Note that the refrigeration cycle apparatus may include a control unit capable of switching the second switching mechanism and controlling the first operation.

Note that, in the second operation, all of the plurality of second heat exchangers may function as radiators for the second refrigerant. Alternatively, the second heat exchanger functioning as a radiator for the second refrigerant and the second heat exchanger in an operation stop state or a state in which the second refrigerant does not flow may coexist in the plurality of second heat exchangers.

Note that the refrigeration cycle apparatus may include a control unit capable of switching the second switching mechanism and controlling the second operation.

Note that the refrigeration cycle apparatus may include a control unit capable of switching the second switching mechanism and controlling the third operation.

Note that the refrigeration cycle apparatus may include a control unit capable of switching the second switching mechanism and controlling the fourth operation.

Note that the on-off valve only needs to be a valve capable of at least being in an open state and a closed state, and may be a valve capable of switching between two states of the open state and the closed state, or may be a valve capable of controlling a valve opening degree in stages.

Note that the first refrigerant is preferably a refrigerant having higher capacity than the second refrigerant.

Further, the flammability can be compared according to classifications related to ASHRAE 34 flammability, for example.

Note that the toxicity can be compared, for example, according to classifications related to ASHRAE 34 safety grade.

Supplementary Note

Although the embodiments of the present disclosure have been described above, it will be understood that various changes in form and details can be made without departing from the spirit and scope of the present disclosure described in claims.

REFERENCE SIGNS LIST

1: refrigeration cycle apparatus.
2: heat source unit
2*x*: heat source casing
3*a*: first utilization unit
3*b*: second utilization unit
3*c*: third utilization unit
5: primary-side unit
5*a*: primary-side refrigerant circuit (first circuit)
5*x*: primary-side casing
7: secondary-side third connection pipe (third connection flow path)
8: secondary-side first connection pipe (first connection flow path)
9: secondary-side second connection pipe (second connection flow path)
10: secondary-side refrigerant circuit (second circuit)
12: heat source circuit
13*a*, 13*b*, 13*c*: utilization circuit
15*a*, 15*b*, 15*c*: first connection pipe (first connection flow path and second connection flow path)
16*a*, 16*b*, 16*c*: second connection pipe (third connection flow path)
20: heat source-side control unit
21: secondary-side compressor (second compressor)
21*a*: compressor motor
22: secondary-side switching mechanism (second switching mechanism)
22*a*: first switching valve (four-way switching valve)
22*b*: second switching valve (four-way switching valve)
22*x*: discharge-side connection portion
22*y*: suction-side connection portion (portion on suction flow path side)
23: suction flow path

24: discharge flow path
25: third heat source pipe
26: fourth heat source pipe (third connection flow path)
27: fifth heat source pipe (third connection flow path)
28: first heat source pipe (first connection flow path)
29: second heat source pipe (second connection flow path)
30: secondary-side accumulator
34: oil separator
35: cascade heat exchanger
35*a*: secondary-side flow path (second portion)
35*b*: primary-side flow path (first portion)
36: heat source-side expansion valve
37: secondary-side suction pressure sensor
38: secondary-side discharge pressure sensor
39: secondary-side discharge temperature sensor
40: oil return circuit
41: oil return flow path
42: oil return capillary tube
44: oil return on-off valve
45: secondary-side receiver
46: bypass circuit
46*a*: bypass expansion valve
47: secondary-side subcooling heat exchanger
48: secondary-side subcooling circuit
48*a*: secondary-side subcooling expansion valve
50*a-c*: utilization-side control unit
51*a-c*: utilization-side expansion valve
52*a-c*: utilization-side heat exchanger (second heat exchanger)
53*a-c*: indoor fan
56*a*, 56*b*, 56*c*: second utilization pipe (third connection flow path)
57*a*, 57*b*, 57*c*: first utilization pipe (first connection flow path and second connection flow path)
58*a*, 58*b*, 58*c*: liquid-side temperature sensor
60*a*, 60*b*, 60*c*: branch unit control unit
61*a*, 61*b*, 61*c*: third branch pipe (third connection flow path)
62*a*, 62*b*, 62*c*: junction pipe (first connection flow path and second connection flow path)
63*a*, 63*b*, 63*c*: first branch pipe (first connection flow path)
64*a*, 64*b*, 64*c*: second branch pipe (second connection flow path)
66*a*, 66*b*, 66*c*: first control valve
67*a*, 67*b*, 67*c*: second control valve
68*a*, 68*b*, 68*c*: check valve
69*a*, 69*b*, 69*c*: bypass pipe
70: primary-side control unit
71: primary-side compressor (first compressor)
72: primary-side switching mechanism (first switching mechanism)
74: primary-side heat exchanger (first heat exchanger)
76: primary-side first expansion valve
77: outdoor air temperature sensor
78: primary-side discharge pressure sensor
79: primary-side suction pressure sensor
81: primary-side suction temperature sensor
82: primary-side heat-exchange temperature sensor
83: secondary-side cascade temperature sensor
84: receiver outlet temperature sensor
85: bypass circuit temperature sensor
86: subcooling outlet temperature sensor
87: subcooling circuit temperature sensor
88: secondary-side suction temperature sensor
80: control unit
102: primary-side second expansion valve
103: primary-side subcooling heat exchanger
104: primary-side subcooling circuit
104*a*: primary-side subcooling expansion valve
105: primary-side accumulator
111: primary-side first connection pipe
112: primary-side second connection pipe
113: first refrigerant pipe
114: second refrigerant pipe
166*a*, 166*b*, 166*c*: first control valve
167*a*, 167*b*, 167*c*: second control valve
122*a*: first three-way valve (three-way valve)
122*b*: second three-way valve (three-way valve)
222*a*: first on-off valve (on-off valve)
222*b*: second on-off valve (on-off valve)
222*c*: third on-off valve (on-off valve)
222*d*: fourth on-off valve (on-off valve)

CITATION LIST

Patent Literature

Patent Literature 1: WO 2018/235832 A

The invention claimed is:

1. A refrigeration cycle apparatus comprising:

a processor, a first circuit, in which a first refrigerant circulates, including a first compressor, a first portion of a cascade heat exchanger, a first heat exchanger, and a first switching mechanism located between the first compressor and the first heat exchanger and switching a flow path; and a second circuit, in which a second refrigerant circulates, including a second compressor, a discharge flow path extending from a discharge side of the second compressor, a suction flow path extending from a suction side of the second compressor, a second portion of the cascade heat exchanger, a second switching mechanism, a plurality of second heat exchangers, a first connection flow path, a second connection flow path, and a third connection flow path, wherein the first connection flow path connects the second switching mechanism and the plurality of second heat exchangers, the second connection flow path connects the plurality of second heat exchangers and the suction flow path or a portion of the second switching mechanism on a suction flow path side, the third connection flow path connects the plurality of second heat exchangers and the second portion of the cascade heat exchanger, the second switching mechanism is connected with the discharge flow path, the suction flow path, a flow path extending from the second portion of the cascade heat exchanger, and the first connection flow path, and switches a flow of the second refrigerant within the second circuit, the second refrigerant is a carbon oxide, and the processor is configured to control the first compressor so that the second refrigerant flowing through the second portion of the cascade heat exchanger does not exceed a critical point.

2. The refrigeration cycle apparatus according to claim 1, wherein a first operation of causing the cascade heat exchanger to function as a radiator for the second refrigerant and causing the plurality of second heat exchangers to function as evaporators for the second refrigerant is possible, and in the second switching mechanism, the flow of the second refrigerant within the second circuit is switched during the first operation such that the discharge flow path and the flow path extending from the second portion of the cascade heat exchanger are connected and the discharge flow path and the first connection flow path are not connected.

3. The refrigeration cycle apparatus according to claim 1, wherein a second operation of causing the cascade heat exchanger to function as an evaporator for the second refrigerant and causing the plurality of second heat exchangers to function as radiators for the second refrigerant is possible, and in the second switching mechanism, the flow of the second refrigerant within the second circuit is switched during the second operation such that the discharge flow path and the flow path extending from the second portion of the cascade heat exchanger are not connected and the discharge flow path and the first connection flow path are connected.

4. The refrigeration cycle apparatus according to claim 1, wherein a third operation in which the cascade heat exchanger is caused to function as a radiator for the second refrigerant and the plurality of second heat exchangers includes both the second heat exchanger functioning as a radiator for the second refrigerant and the second heat exchanger functioning as an evaporator for the second refrigerant is possible, and in the second switching mechanism, the flow of the second refrigerant within the second circuit is switched during the third operation such that the discharge flow path and the flow path extending from the second portion of the cascade heat exchanger are connected and the discharge flow path and the first connection flow path are connected.

5. The refrigeration cycle apparatus according to claim 1, wherein a fourth operation in which the cascade heat exchanger is caused to function as an evaporator for the second refrigerant and the plurality of second heat exchangers includes both the second heat exchanger functioning as a radiator for the second refrigerant and the second heat exchanger functioning as an evaporator for the second refrigerant is possible, and in the second switching mechanism, the flow of the second refrigerant within the second circuit is switched during the fourth operation such that the discharge flow path and the flow path extending from the second portion of the cascade heat exchanger are not connected and the discharge flow path and the first connection flow path are connected.

6. The refrigeration cycle apparatus according to claim 1, wherein the first heat exchanger exchanges heat between the first refrigerant and outdoor air.

7. The refrigeration cycle apparatus according to claim 6, wherein at least either heat absorbing capacity or heat releasing capacity of the first refrigerant in the first portion of the cascade heat exchanger is adjustable by controlling a state of a refrigeration cycle of the first refrigerant in the first circuit.

8. The refrigeration cycle apparatus according to claim 1, wherein the second switching mechanism includes any of two four-way switching valves provided in parallel on the discharge side of the second compressor, two three-way valves provided in parallel on the discharge side of the second compressor, or two on-off valves provided in parallel on the discharge side of the second compressor and two on-off valves provided in parallel on the suction side of the second compressor.

9. The refrigeration cycle apparatus according to claim 1, wherein the first refrigerant and the second refrigerant are different in refrigerant type.

10. The refrigeration cycle apparatus according to claim 9, wherein the second refrigerant has at least one of lower global warming potential, lower ozone depletion potential, lower flammability, and lower toxicity than the first refrigerant.

11. The refrigeration cycle apparatus according to claim 2, wherein a second operation of causing the cascade heat exchanger to function as an evaporator for the second refrigerant and causing the plurality of second heat exchangers to function as radiators for the second refrigerant is possible, and in the second switching mechanism, the flow of the second refrigerant within the second circuit is switched during the second operation such that the discharge flow path and the flow path extending from the second portion of the cascade heat exchanger are not connected and the discharge flow path and the first connection flow path are connected.

12. The refrigeration cycle apparatus according to claim 2, wherein a third operation in which the cascade heat exchanger is caused to function as a radiator for the second refrigerant and the plurality of second heat exchangers includes both the second heat exchanger functioning as a radiator for the second refrigerant and the second heat exchanger functioning as an evaporator for the second refrigerant is possible, and in the second switching mechanism, the flow of the second refrigerant within the second circuit is switched during the third operation such that the discharge flow path and the flow path extending from the second portion of the cascade heat exchanger are connected and the discharge flow path and the first connection flow path are connected.

13. The refrigeration cycle apparatus according to claim 3, wherein a third operation in which the cascade heat exchanger is caused to function as a radiator for the second refrigerant and the plurality of second heat exchangers includes both the second heat exchanger functioning as a radiator for the second refrigerant and the second heat exchanger functioning as an evaporator for the second refrigerant is possible, and in the second switching mechanism, the flow of the second refrigerant within the second circuit is switched during the third operation such that the discharge flow path and the flow path extending from the second portion of the cascade heat exchanger are connected and the discharge flow path and the first connection flow path are connected.

14. The refrigeration cycle apparatus according to claim 2, wherein a fourth operation in which the cascade heat exchanger is caused to function as an evaporator for the second refrigerant and the plurality of second heat exchangers includes both the second heat exchanger functioning as a radiator for the second refrigerant and the second heat exchanger functioning as an evaporator for the second refrigerant is possible, and in the second switching mechanism, the flow of the second refrigerant within the second circuit is switched during the fourth operation such that the discharge flow path and the flow path extending from the second portion of the cascade heat exchanger are not connected and the discharge flow path and the first connection flow path are connected.

15. The refrigeration cycle apparatus according to claim 3, wherein a fourth operation in which the cascade heat exchanger is caused to function as an evaporator for the second refrigerant and the plurality of second heat exchangers includes both the second heat exchanger functioning as a radiator for the second refrigerant and the second heat exchanger functioning as an evaporator for the second refrigerant is possible, and in the second switching mechanism, the flow of the second refrigerant within the second circuit is switched during the fourth operation such that the discharge flow path and the flow path extending from the second portion of the cascade heat exchanger are not connected and the discharge flow path and the first connection flow path are connected.

16. The refrigeration cycle apparatus according to claim 4, wherein a fourth operation in which the cascade heat exchanger is caused to function as an evaporator for the second refrigerant and the plurality of second heat exchangers includes both the second heat exchanger functioning as a radiator for the second refrigerant and the second heat exchanger functioning as an evaporator for the second refrigerant is possible, and in the second switching mechanism, the flow of the second refrigerant within the second circuit is switched during the fourth operation such that the discharge flow path and the flow path extending from the second portion of the cascade heat exchanger are not connected and the discharge flow path and the first connection flow path are connected.

17. The refrigeration cycle apparatus according to claim 2, wherein the first heat exchanger exchanges heat between the first refrigerant and outdoor air.

18. The refrigeration cycle apparatus according to claim 3, wherein the first heat exchanger exchanges heat between the first refrigerant and outdoor air.

19. The refrigeration cycle apparatus according to claim 4, wherein the first heat exchanger exchanges heat between the first refrigerant and outdoor air.

* * * * *